United States Patent [19]

Wells et al.

[11] 4,098,333

[45] Jul. 4, 1978

[54] MARINE PRODUCTION RISER SYSTEM

[75] Inventors: Donald R. Wells, Villa Park; Raymond W. Walker, Huntington Beach, both of Calif.

[73] Assignee: Compagnie Francaise des Petroles, Paris, France

[21] Appl. No.: 771,799

[22] Filed: Feb. 24, 1977

[51] Int. Cl.[2] ..... E21B 33/035; E21B 43/01

[52] U.S. Cl. ..... 166/0.5; 175/7

[58] Field of Search ..... 166/0.5, 0.6; 61/94, 61/97; 175/7

[56] References Cited

U.S. PATENT DOCUMENTS

| | | | |
|---|---|---|---|
| 3,261,398 | 7/1966 | Haeber | 166/0.5 |
| 3,332,484 | 7/1967 | Watkins | 166/0.6 |
| 3,472,032 | 10/1969 | Howard | 166/0.5 |
| 3,504,741 | 4/1970 | Baker et al. | 166/0.5 |
| 3,532,579 | 8/1970 | Nelson | 166/0.6 |
| 3,602,300 | 8/1971 | Jaffe | 166/0.5 |
| 3,760,875 | 9/1973 | Busking | 166/0.5 |
| 3,894,582 | 7/1975 | Kammerer | 166/0.5 |

*Primary Examiner*—James A. Leppink
*Attorney, Agent, or Firm*—Poms, Smith, Lande & Glenny

[57] ABSTRACT

A marine riser system for offshore well installations having a plurality of satellite subsea wells wherein production flow is conducted to a composite manifold structure on the sea floor, is raised to a floating platform for processing and processed production fluid is then returned to the manifold for transfer to storage or other facility. A riser pipe system which extends between the manifold structure at the sea floor and a floating platform wherein unprocessed production fluid is transported under high pressure in the riser system by a plurality of satellite or perimeter riser pipes which are arranged in a circle about a central riser pipe and which are separately and independently supported and maintained. Processed production fluid is conducted under low pressure through the central riser pipe at the center of the arrangement of satellite pipes, the central riser pipe providing a main structural member for the riser system. A marine riser pipe system having an upper riser pipe portion including central and satellite riser sections supported and carried by the floating platform and a lower riser pipe portion and buoyant structure associated therewith which include corresponding riser sections and which is capable of independently supporting itself in water when separated from the upper riser portion. A guiding and connecting assembly provides quick connecting and disconnecting of the upper riser portion to the buoyant structure, the lower riser portion with the buoyant structure being capable of standing vertically by itself. The manifold includes a releasable manifold section for maintenance and repair. A control system is provided at the manifold structure for actuation and monitoring of equipment installed on the manifold structure and on satellite wells. The control system is remotely controlled from the platform or vessel.

29 Claims, 21 Drawing Figures

Fig. 21.
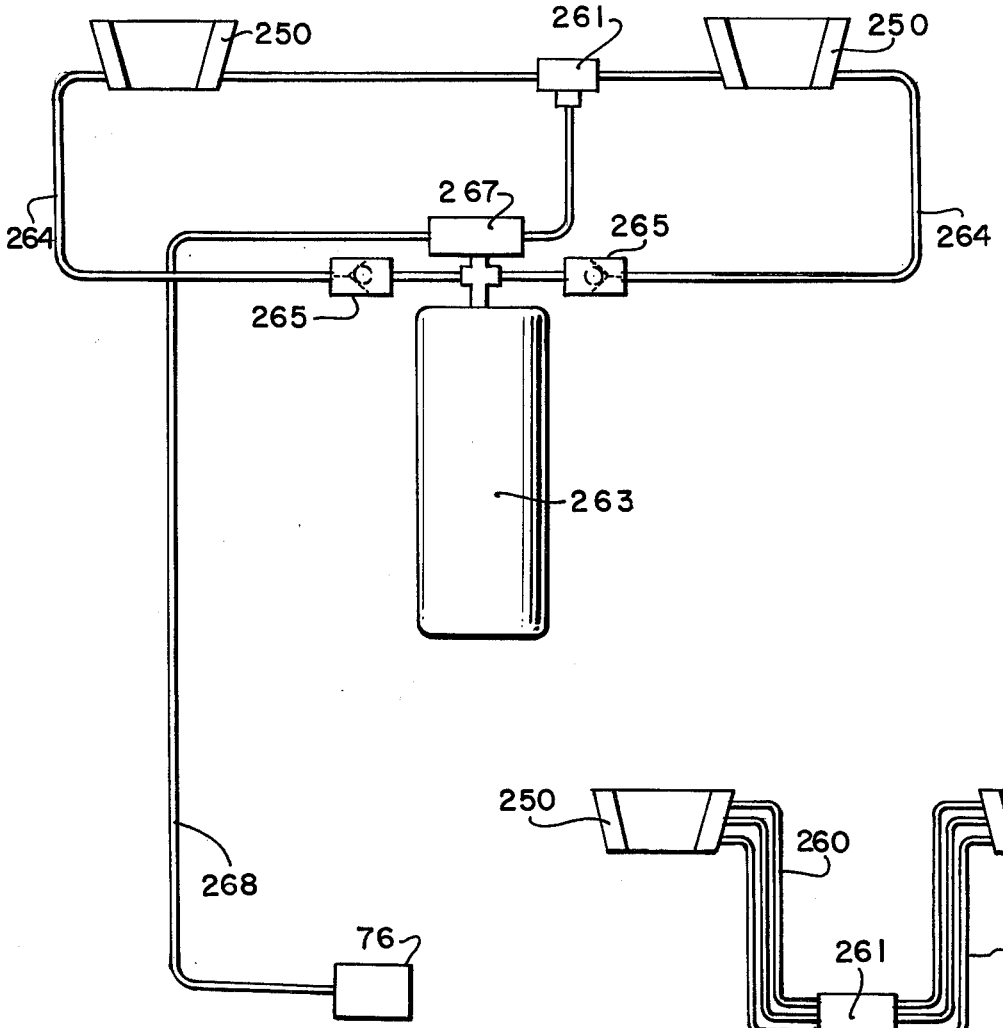
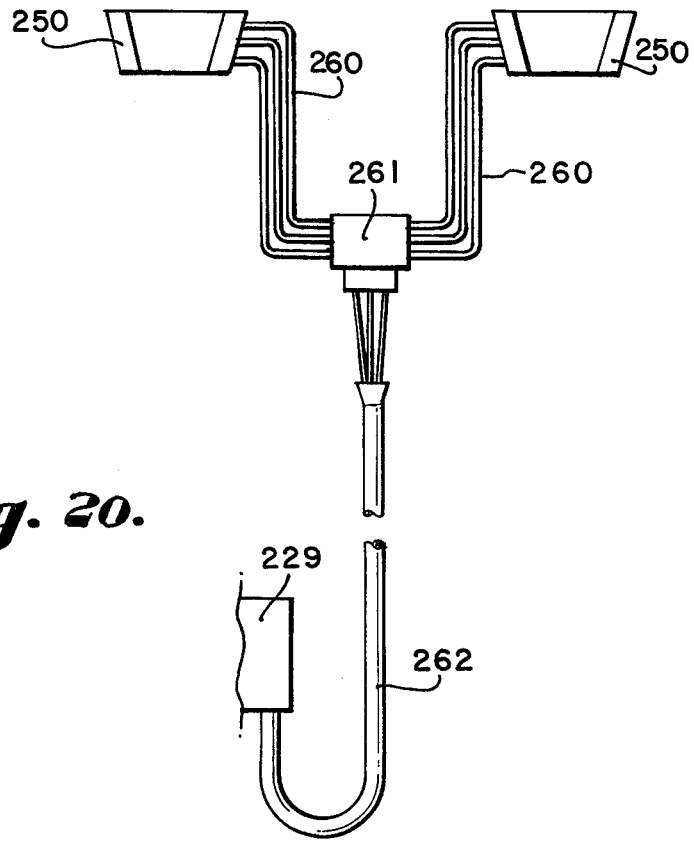
Fig. 20.

MARINE PRODUCTION RISER SYSTEM

BACKGROUND OF THE INVENTION

In the offshore production of hydrocarbon fluids from a plurality of satellite wells in a subsea oil field, production fluid is often conducted along the seabed in flowlines to a central area or station where the production fluid may be conducted upwardly to a floating platform or vessel for initial processing. After processing, the processed fluid may be transferred to another area for storage or for further treatment. Very often, the processed fluid is returned to the seabed and conducted by another flowline to a storage facility, tanker, or onshore facility.

In the development of subsea oil fields of relatively shallow water depth, such as a few hundred feet, the transfer of production fluid from the seabed to a floating platform or vessel was not difficult. Subsea oil wells are being proposed for drilling and production at greater depths of water, such as 1,000 to 6,000 feet or more. The water environment for such depths poses problems not heretofore encountered.

Prior proposed riser constructions have included a single riser pipe extending from a seabed installation to a floating platform. Where a plurality of well holes were drilled in a subsea oil field, each well hole may have had its individual riser pipe extending to a floating platform. In other prior riser pipe constructions, an articulated multi-line riser was connected to a buoyant structure which was submerged at diver depth and which was connected to the top of a self-standing riser which extended downwardly to a foundation structure having a manifold serving as a collecting station for flowlines to the satellite wells.

A plurality of fluid conducting lines were included in the self-standing riser and the articulated portion of the riser above the buoyancy chamber included a plurality of flexible fluid conducting lines. The vertical forces resulting from the buoyant structure and acting on the manifold base was relieved by a weight carried by the riser just above the base. See British Patent No. 1,404,775.

An underwater buoy for a riser pipe to tension the pipe is shown in Canadian Patent No. 949,877. Other prior proposed solutions to the problems of applying a tensile force to the top of the riser pipe to prevent buckling have included the use of floatation jackets about the riser pipe at selected depths to relieve the tensioning system, and the provision of means for causing the buoy to rise at an angle and surface away from the vessel in the event the riser pipe breaks beneath the buoy. See U.S. Pat. No. 3,855,656.

In U.S. Pat. No. 3,729,756, a riser pipe is described in which a floatation collar is positioned around the riser pipe, the floatation collar comprising a plurality of plastic hollow spheres surrounded by a syntactic foam having a protective outer shell.

SUMMARY OF INVENTION

This invention relates to a production riser construction adapted for use between a surface station, such as a floating platform or vessel, and a base manifold means on the seabed for conducting fluid from a plurality of flowlines from satellite wells on the seabed to a surface platform for processing and for then returning processed fluid to the seabed for conveyance to suitable storage or distribution means.

The riser means of this invention is constructed and supported in novel manner to enhance installation, operation, and maintenance and particularly to provide means for quickly connecting and disconnecting a relatively short upper riser portion from a relatively long lower riser portion. Generally speaking, a submerged buoyant structure is located between upper and lower riser portions at a sufficient depth to reduce exposure of the buoyant structure to the high energy effect of ocean wind and wave surface conditions and yet be readily reachable by divers, an exemplary depth being about 300 feet. A selected depth of about 300 feet also enables the upper portion of the riser between the platform and buoyant structure to be rapidly retrieved in a relatively short time, if necessary, as compared to pulling in a riser 3000 feet long or a lower riser portion of that length. Extending between the floating vessel and the submerged buoyant structure are a plurality of upper riser lines which in one example are flexible and in another example are rigid. The upper riser lines comprise central and satellite lines which are supported from the platform, are releasably connected to the upper buoyant structure in novel manner, impose virtually no load on the buoyant structure, and at their upper ends are independently tensioned to adjust stresses imposed on the riser lines caused by variance in fluids carried and other forces acting on the lines.

The submerged buoyant structure is uniquely constructed and arranged to support lower riser lines, which also include central and satellite lines, without help from the upper riser lines so that buoyant structure and the lower riser lines are virtually free-standing. The invention contemplates that the upper buoyant structure include means for releasably connecting the upper riser lines in fluid communication with the lower riser lines at the level of the buoyant structure. The invention contemplates that the central riser line provide a structural support for other riser lines. Satellite or perimeter riser lines are circularly arranged about the central riser line, but each riser line is capable of separate independent support and removal.

The primary object therefore of the present invention is to provide a novel subsea production riser system for a plurality of satellite subsea wells.

An object of the invention is to provide a novel riser system including a plurality of riser lines supported in novel manner.

Another object of the invention is to provide a riser system including upper and lower riser portions releasably interconnected at the level of a buoyant structure.

Another object of the invention is to provide in such a riser system an upper riser portion with central and satellite riser pipes, the central riser pipe serving as a suspension support means for the satellite riser pipes.

Still another object of the invention is to provide a riser system as described above wherein satellite riser pipes in upper and lower riser portions are adapted for independent retrieval and maintenance.

A still further object of the present invention is to provide a riser system as mentioned above including control means at a base manifold means for controlling and monitoring equipment at the satellite subsea wells and at the manifold base means.

A still further object of the invention is to provide a riser system as above wherein the lower riser portion and the buoyant structure provide positive buoyancy whereby the lower riser portion is capable of standing by itself in the water when an upper riser portion is disconnected from the buoyant structure.

A still further object of the invention is to provide a riser system as described above wherein the central riser pipe of the lower riser portion is carried by and supported from the buoyant structure.

A still further object of the invention is to provide a riser system including a buoyant structure which is provided with guide means for central and satellite riser pipes which provide fluid communication between a base manifold means and a floating platform.

Another object of the invention is to provide a riser pipe system including guidance means for satellite riser pipes to maintain radial and lateral positions relative to a central riser pipe.

The invention particularly contemplates a guidance and connector means located above a buoyant structure whereby an upper riser portion may be quickly disconnected from the riser system therebelow for releasing a production platform or vessel therefrom in the event of adverse severe weather and whereby reconnection of the upper riser portion to the remaining part of the riser system may be quickly and readily accomplished upon improved weather conditions.

The invention contemplates a production riser system for deep water including a floating platform, a base manifold means on the seabed, a riser means extending between the manifold base means and the floating platform and including a buoyant structure therebetween, the riser means having an upper riser portion and a lower riser portion and means quickly releasably interconnecting the riser portions at the level of the buoyant structure, and control means at the base manifold means for controlling and monitoring equipment at satellite subsea wells and at the manifold means.

Other advantages and objects of the present invention will be readily apparent from the following description of the drawings in which exemplary embodiments of the invention are shown.

IN THE DRAWINGS

FIG. 20 is a schematic shuttle valve means used with the stab assembly shown in FIG. 18.

FIG. 21 is a schematic hydraulic circuit arrangement including an accumulator associated with the stab assembly.

Figure 1:
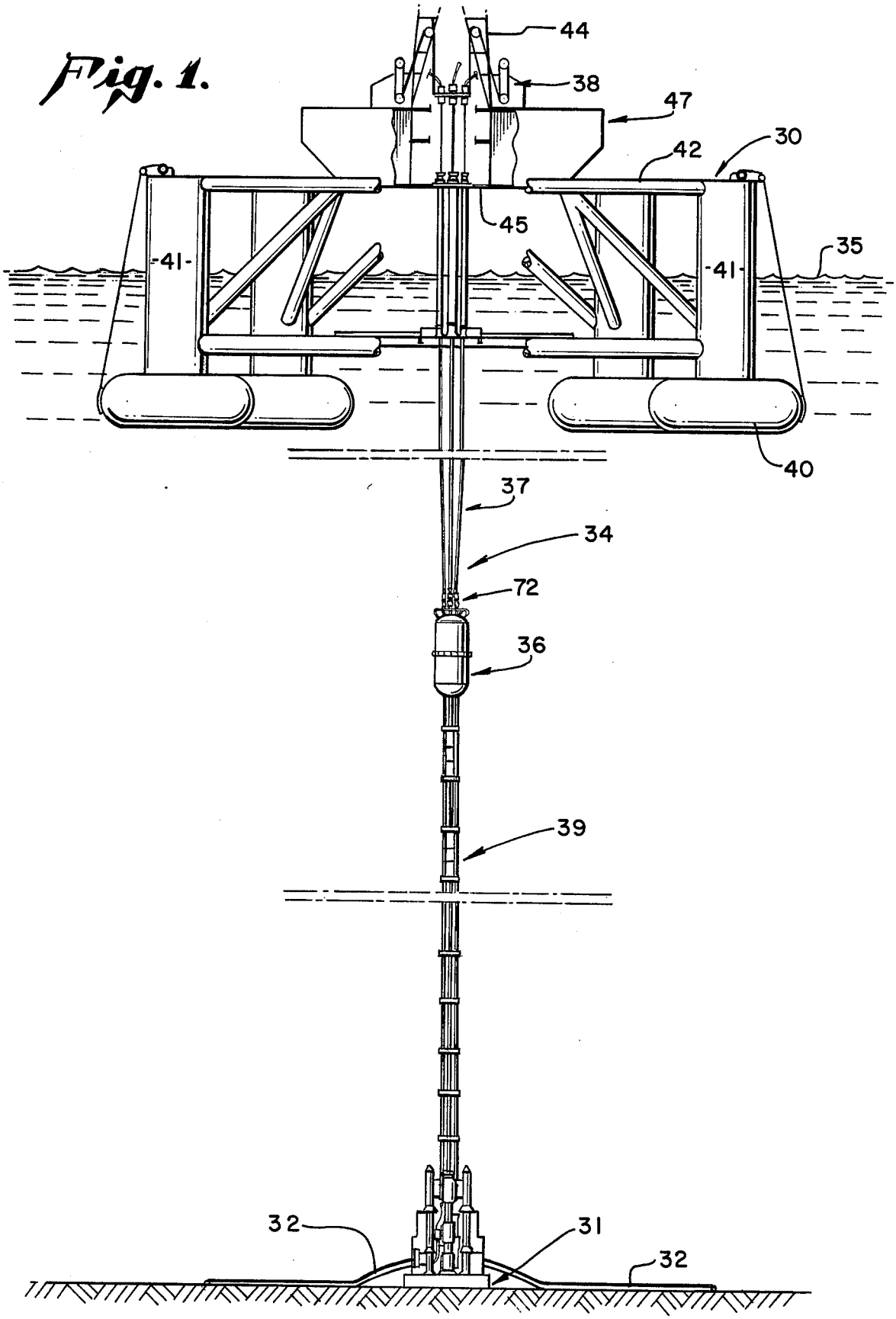
FIG. 1 is an elevational view of a production riser system embodying this invention and showing the riser means extending between a manifold base means and a floating platform.

An exemplary embodiment of the present invention is schematically indicated in FIG. 1 wherein a floating platform 30 is positioned over a composite manifold base means 31 which serves as a collection of assembly points for a plurality of flowlines 32 each connected to a subsea wellhead located remotely from the manifold base means 31. A riser means 34 extends between and interconnects the manifold base means 31 with platform 30. At a selected depth below surface 35 of the sea is provided a buoyant structure 36 to which the lower end of an upper riser portion 37 is releasably connected by a guidance and connecting means or stab assembly 72. The upper end of upper riser portion 37 is connected to termination means 38 on platform 30. Below buoyant structure 36 and extending to and interconnecting manifold base means 31 with structure 36 is a lower riser portion 39. Lower riser portion 39 includes buoyant members along its length to reduce its weight in water. Between buoyant structure 36 and base manifold means 31 riser portion 39 is negatively buoyant to facilitate its installation. Buoyant structure 36 is sufficiently positively buoyant so that the combined buoyant forces of portion 39 and structure 36 are adequately positively buoyant whereby lower riser portion 39 and buoyant structure 36 stand vertically in the event upper riser portion 37 should be separated and disengaged from buoyant structure 36. Upper riser portion 37 is connected to and supported from platform 30 so that little or no downwardly directed loads are imparted to buoyant structure 36.

Also, generally speaking, riser means 34 comprises an arrangement of a central riser pipe which provides flow of low pressure processed production fluid from platform 30 to manifold base means 31 for redistribution to storage or other facilities. Peripherally and circularly arranged around the central riser pipe are a plurality of perimeter or satellite riser pipes for carrying high pressure, unprocessed production fluids from seabed flowlines 32 through the base manifold means 31 and through lower riser portion 39, buoyant structure 36, and upper riser portion 37 for processing or other disposition on platform 30.

FLOATING PLATFORM

Floating platform 30 is illustrated as a semi-submersible platform structure and may comprise an arrangement of horizontal, buoyant members 40 connected to vertical column buoyant members 41, which extend above sea surface 35 and support a platform deck 42. Platform 30 includes diagonal and horizontal bracing frame members of suitable design and construction for interconnecting the platform deck, vertical columns 41, and horizontal members 40.

Platform deck 42 supports a derrick rig 44 of suitable construction above a moon pool of opening 45 through which extends the upper end of upper riser portion 37. Deck structure 47 is schematically illustrated and may be provided with well-known equipment, such as storage winches, lifting winches, constant tensioning means, and corresponding structural design to facilitate installation of the manifold base means, the lower riser portion, the buoyant structure, the central and satellite riser pipes, the upper riser portion, and necessary control means. The equipment also may include winch means, motion compensator means, riser and guideline tensioners, deck cranes, and other well-known equipment capable of initial installation of the riser system and of recovery or retrieval of various portions of the riser system as described hereafter.

Figure 2:
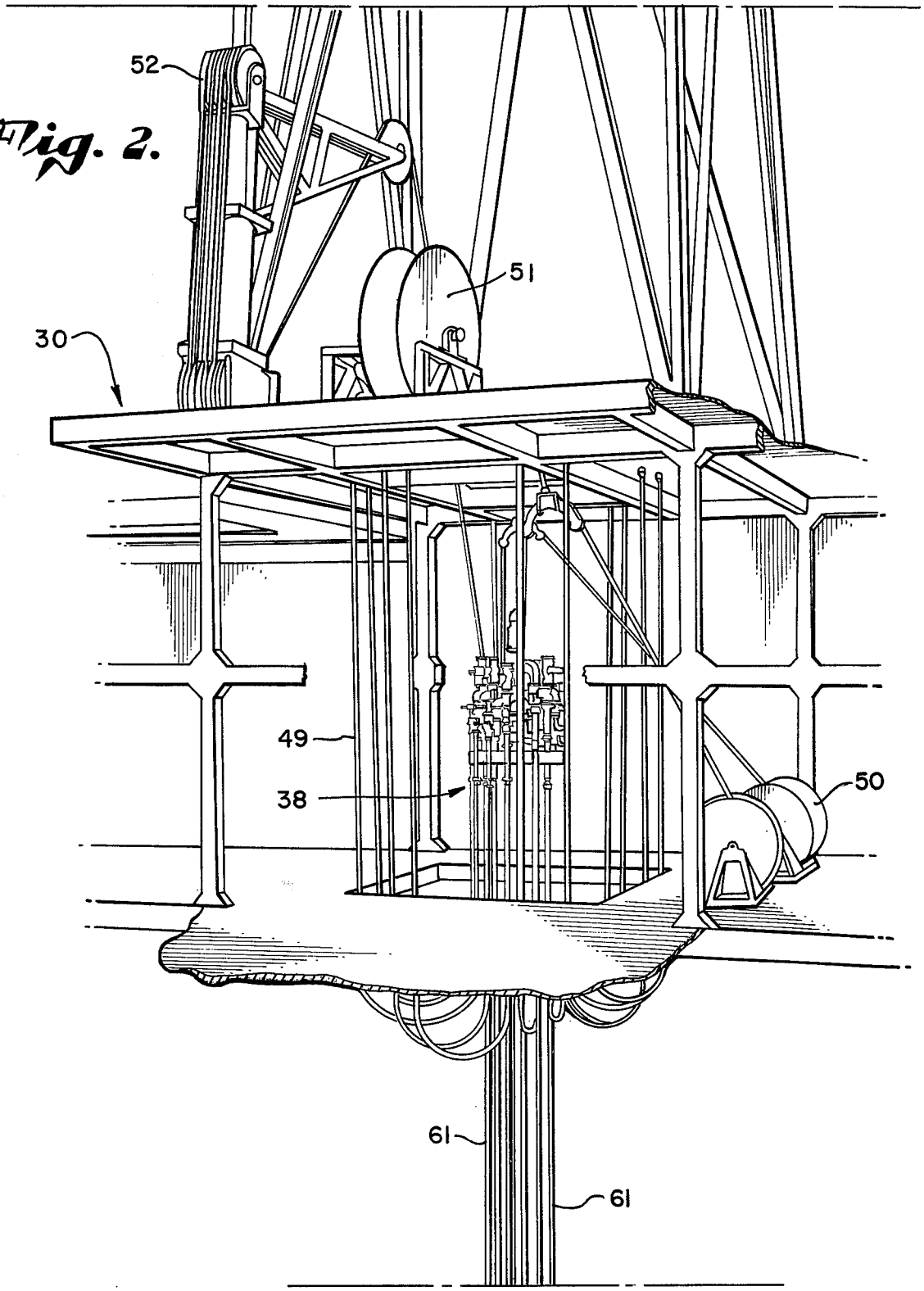
FIG. 2 is an enlarged perspective view of a portion of the platform illustrating the manner in which the upper end of an upper riser portion is connected to the platform.

FIG. 2 generally indicates a portion of such a deck structure including termination means 38 for upper riser portion 37 and jumper hoses 49 attached thereto and having slack loops of selected length. Winches 50, for controlling umbilical lines to a guide and connecting means or stab assembly 72 at the bottom of the upper riser portion, are generally illustrated; a storage winch 51 for storing a selected length of umbilical line to extend to manifold base means 31 is shown, and a constant tensioning means 52 is generally also indicated. Equipment indicated in FIG. 2 is exemplary only since the use of various types of equipment for installing riser systems is well-known.

Floating platform 30 may be moored by mooring lines, not shown. It will be understood that platform 30 may be a floating vessel, a dynamically positionable vessel, a tension leg platform, or other types of offshore platform constructions.

RISER MEANS

Riser means 34 includes upper riser portion 37, lower riser portion 39 and buoyant structure 36 therebetween. The embodiment of upper riser means 37 (FIGS. 3 and 4) comprises rigid steel pipe for a central riser pipe 60 and for each of the plurality of satellite riser pipes 61. In another example of upper riser portion 37 (FIGS. 5 and 6) the central and satellite riser pipes comprise flexible tubing as hereafter described.

STEEL UPPER RISER PORTION (FIGS. 3 AND 4)

Upper riser portion 37 (FIG. 3) comprises a central steel riser pipe 60 of selected length having pipe sections interconnected by mechanically locked connectors 62. Central riser pipe 60 is carried by and supported from termination plate 63 by a suitable hydraulically operated connector 64 mounted just below plate 63. Above plate 63, connector 64 is in communication with a stand pipe 65 for flow of processed oil.

At selected vertical intervals along portion 37, central riser pipe 60 fixedly supports guide funnel members 67 radially spaced from central riser 60. Suitable radial arms or radially extending plates 68 are secured to central riser pipe 60 and to each of the funnel members 67. Each funnel member 67 is disposed with its vertical axis parallel to the axis of the central riser pipe and the funnels 67 of each guide funnel means 66 are vertically aligned with funnels 67 of guide funnel means 66 axially spaced therefrom along central riser pipe 60. Means for assuring axial alignment of adjacent, separated guide funnel assemblies 66 along the length of the upper riser portion includes the provision of key means (not shown) on each funnel assembly 66 for cooperation with a key element on central riser 60 so that funnel members 67 of each assembly 66 are angularly oriented and correspondingly positioned with respect to central riser pipe 60.

Guide funnel means 66 may be spaced approximately 20 to 25 feet apart along central riser pipe 60. The internal diameter of each guide funnel 67 is greater than the outer diameter of satellite riser pipe 61 so that satellite riser pipe 61 may readily move axially relative to the guide funnels.

Adjacent the bottom of upper riser portion 37, central riser pipe 60 fixedly carries a support plate 70 at a connector 62. Support plate 70 extends radially and provides support and mounting means for satellite pipe connectors 71. Support plate 70, satellite connectors 71, form part of a guide and connecting means, or stab assembly, generally indicated at 72, which is supported from central riser pipe 60 and from termination plate 63 so that upper riser pipe portion loads are not transmitted to buoyant structure 36.

Stab assembly 72 also includes a stand pipe 74, which is connected to support plate 70 and which is coaxial with central riser pipe 60 for flow of processed hydrocarbons downwardly therethrough. Stand pipe 74 may be connected to a ball joint 75 which may permit plus or minus 10° angular deviation of central riser pipe 60 from the vertical. Below ball joint 75, a stab assembly connector 76 provides an hydraulically operable releasably connection to central pipe 112 of buoyant structure 36.

Figure 18:
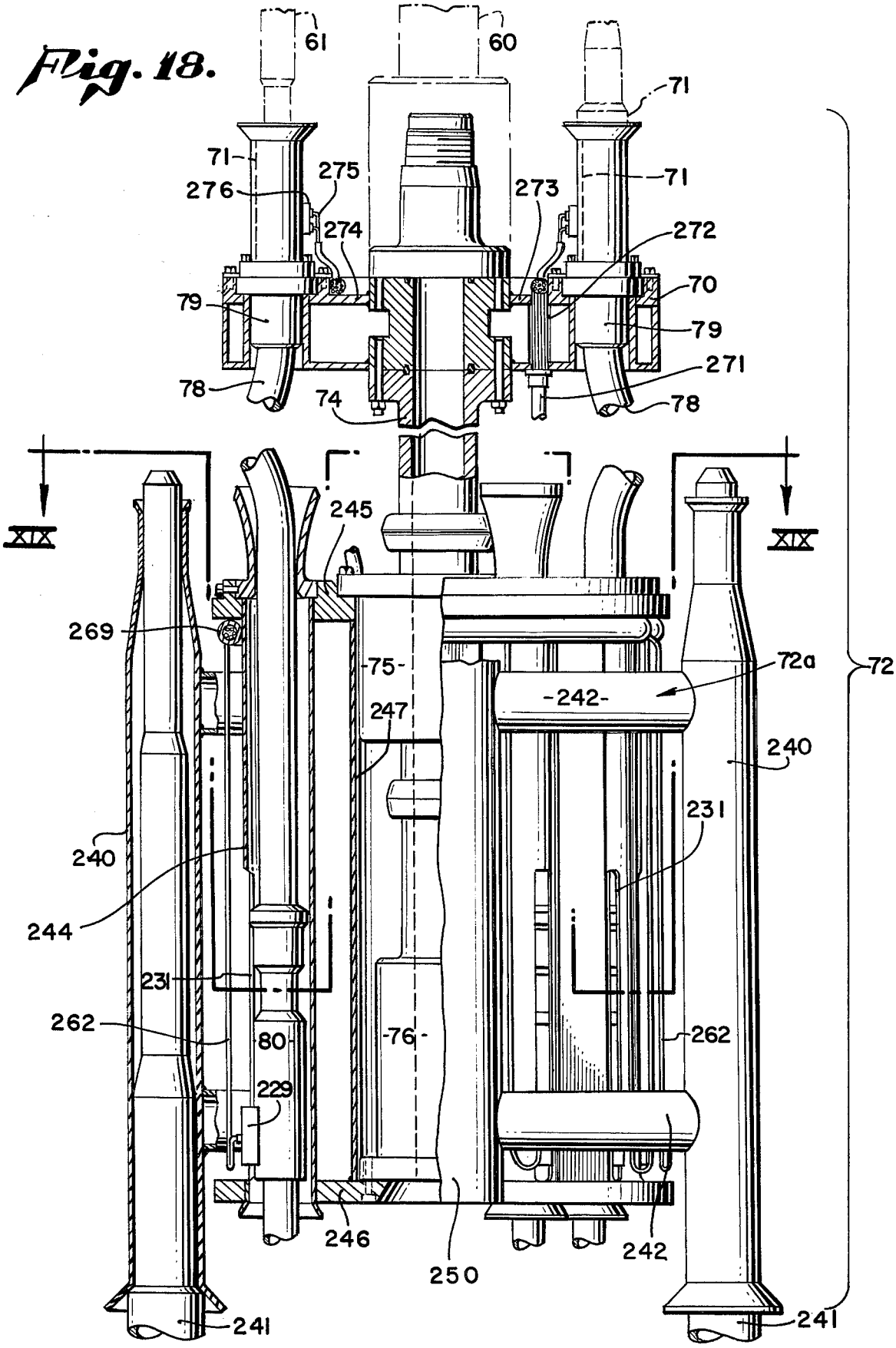
FIG. 18 is an enlarged elevational view, partly in section, of a stab assembly or guiding and connecting means above the top of the buoyant structure.
Figure 19:
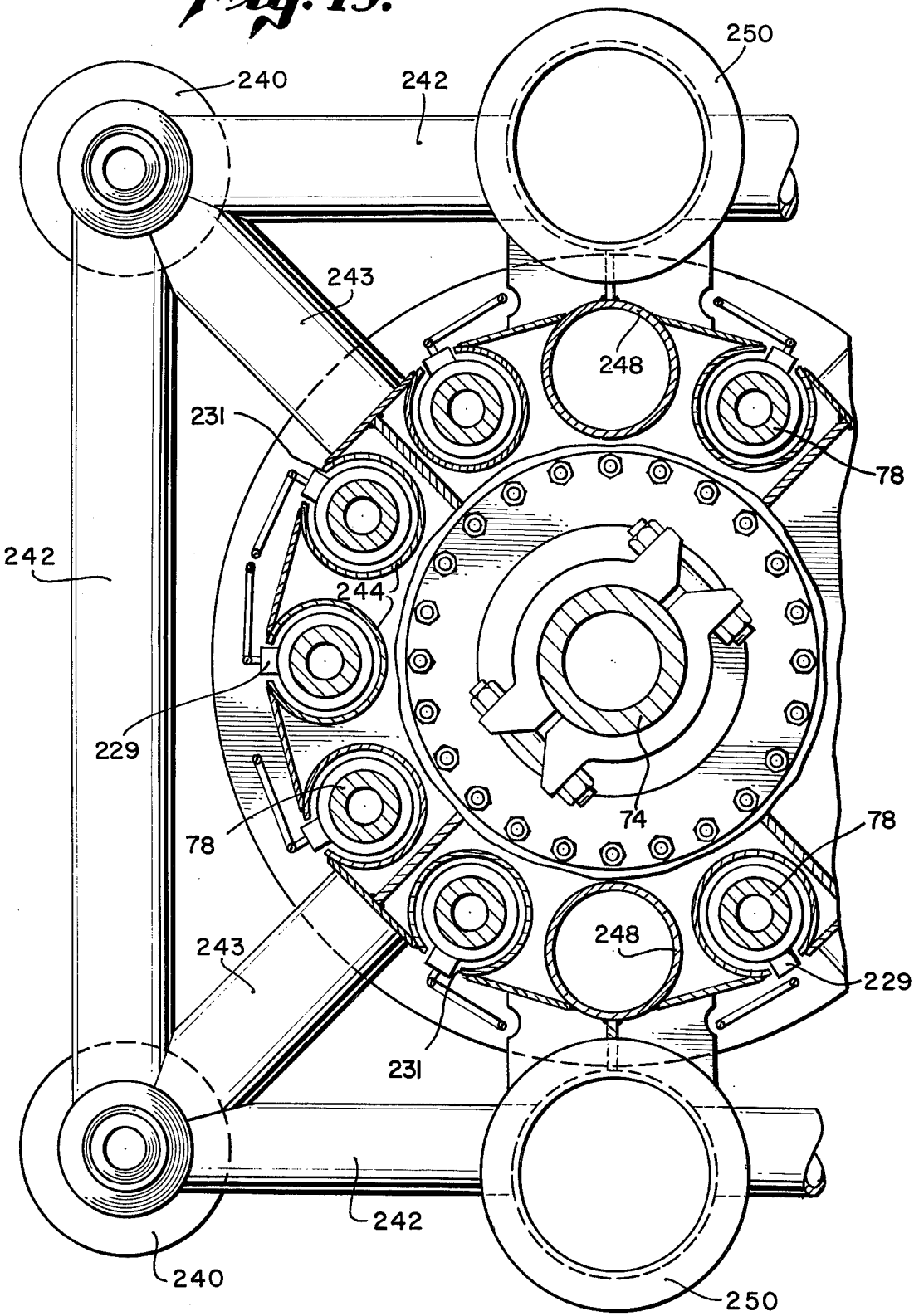
FIG. 19 is a fragmentary sectional view taken in the planes indicated by lines XIX of FIG. 18.

Stab assembly 72, FIGS. 18 and 19, may comprise a frame 72*a* carried at the lower end of standpipe 74. Frame 72*a* may be of square configuration having at corners, upstanding guide tubes 240 for reception of guide posts 241 provided on the top of buoyant structure 36. Frame 72*a* may include suitable horizontal frame members 242 interconnecting guide tubes 240. Diagonal members 243 rigidly support centrally of the square a plurality of circularly arranged satellite connector receptacles 244 interconnecting top and bottom plates 245 and 246. A central receptacle 247 receives the ball joint 75 and the marine connector 76. As best seen in FIG. 19, a pair of diametrically opposed tubular receptacles 248 are provided for passage therethrough of umbilical lines to the base 31.

In this example, along the same diameter may be provided somewhat enlarged tubular receptacles 250 for reception of two control pod lines for controlling the hydraulic circuits actuating the connect and disconnect operations of the satellite connectors and the stab assembly connector just above the buoyant structure 36. Frame 72a also supports hydraulic control means including manifold valve means and equipment required to actuate the central and satellite riser connectors.

Each satellite riser pipe 61 is fed through its associated vertically, axially aligned funnels 67 to support plate 70 where a mandrel provided at the lower end of the satellite riser pipe 61 of this portion provides a connection to a satellite connector means 71. The satellite pipes 61 are connected in the stab assembly 72 to a plurality of flexible jumper hoses 78, each of which has an upper connector 79 for mating with a connector on the support plate 70 and each having at its lower end a connector 80 for making a connection with the upper end of a corresponding satellite riser pipe in lower riser portion 39, such lower satellite riser pipe extending through buoyant structure 36 as later described. Flexible hoses 78 are yieldable to angular deviation of central riser pipe 60.

The upper riser portion, including stab assembly 72, central riser pipe 60 and the plurality of satellite riser pipes 61, as guided by the funnel assemblies 66, are supported from termination plate 63. The central riser pipe 60 is secured to termination plate 63, support plate 70 is secured to central riser pipe 60, and satellite pipes 61 are supported from support plate 70 and extend through termination plate 63. The termination plate 63 is supported from constant tension winches mounted on the platform deck as previously mentioned and connected by winch lines 82 to the termination plate. In this example, a plurality of winch lines 82, such as six, are connected to the periphery of termination plate 63 and exert a constant tension force at the six connections of the winch lines to the termination plate. The effect of such suspension of the upper riser portion is to provide an arrangement which does not resist any moment forces applied by the upper riser portion 37 to the plate 63. Thus, a ball joint or other equivalent is not required at the upper termination of the upper riser pipe portion.

It will be noted that the above described construction of upper riser portion 37 permits satellite pipes 61 to move axially relative to central riser pipe 60 and stab assembly 72. The satellite riser pipes 61 are restrained by the guide funnel members 67 against horizontal, lateral or radial movement.

The upper end of each satellite riser pipe is connected to a compensating hydraulic cylinder means 84 of any well-known make. Above compensating cylinder 84, each satellite riser pipe 61 is provided with a swab valve 85 and immediately therebelow the upper end of the riser pipe may be connected to a shut-off valve 86, an adjustable choke means 87, and a blast joint 88. The lower end of the blast joint 88 is connected to flexible jumper lines 49 for conducting unprocessed fluid to processing tanks and equipment carried on the platform.

Stab assembly 72 provides means for connecting the upper riser portion to the lower riser portion in essentially one operation. The first connection made is at stab assembly connector 76 by the central riser pipe 60. The connections of satellite riser connectors 71 at the support plate 70 are then made, it being understood that flexible hoses 78 have been connected to satellite riser connectors 80 carried by frame 72a and the upper ends of hoses 78 carry mandrels at support plate 70 for connection to riser connectors 71 of the same type as connectors 80.

Control means for actuating stab assembly 72 provides a means for quickly connecting and disconnecting the stab assembly from buoyant structure 36 and free-standing lower riser portion 39. The control means provides for fluid actuation of the stab assembly connector means 76, an accumulator control valve associated therewith, satellite riser connectors 71 and 80, valves associated therewith, fail-safe valves, and a shuttle valve manifold which provides selection of one or more control pods. In this example, the stab assembly provides for two control pods receivable in control pod receptacles 250 arranged in diametrical relation on frame 72a. Each control pod includes hydraulic circuits adapted to actuate the valves and connectors on the stab assembly 72, one control pod serving as a backup for redundant control means for use in the event the other control pod becomes defective or fails to function.

To provide such redundant function, hydraulic control lines 260, FIG. 20, are fed from each control pod receptacle 250 to a shuttle valve manifold 261 which permits switching from one control pod to the other control pod. The shuttle valve manifold 261 is provided with circuit lines 262 which lead to each of the block manifolds 229 provided on riser connectors 80 and 71.

Figure 16:
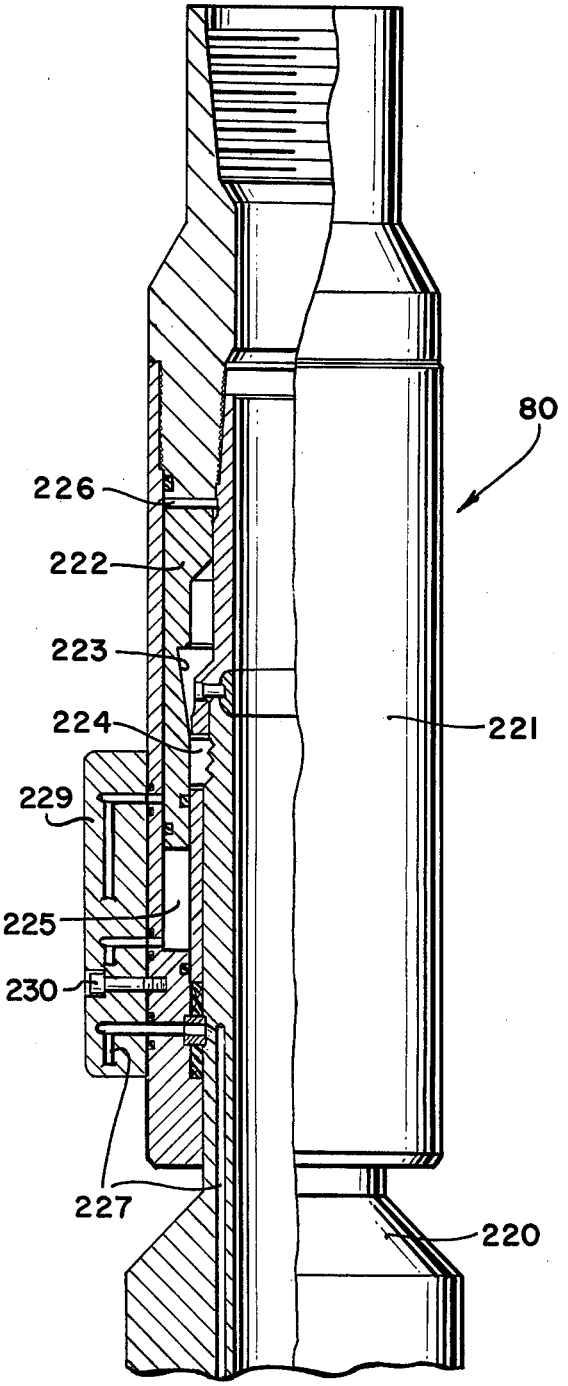
FIG. 16 is an elevational view, partly in section, the section being taken in a longitudinally extending plane passing through the axis of a riser connecting means used in the riser system shown in FIG. 1.
Figure 17:
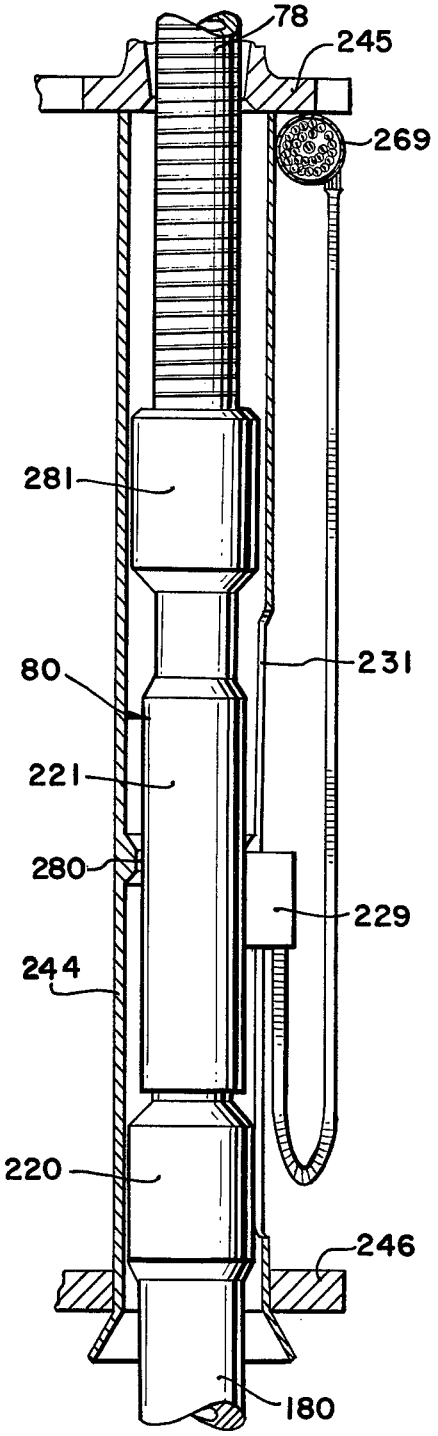
FIG. 17 is a fragmentary view, partly in section, of the control means attachment to a riser connector of FIG. 16.

In FIGS. 16 and 17 is shown an example of a satellite riser connector used in stab assembly 72 or 72'. Satellite riser connector 80 comprises a mandrel 220 provided through buoyant structure 36. Mandrel 220 is received within tubular receptacle 221 carried by the upper satellite riser 61. Between mandrel 220 and receptacle 221 is provided a sleeve piston 222 having an internal cam surface 223 for urging a plurality of circumferentially arranged locking dogs 224 into locking engagement with mandrel 220. Piston 222 is operated by pressure fluid, such fluid entering chamber 225 for driving piston 222 upwardly to lock dogs 224. To unlock dogs 224, pressure fluid is introduced to the chamber at 226 to drive piston 222 downwardly to permit the dogs 224 to retract into the enlarged interior portion of the piston provided by the cam surfaces 223 and to thereby release the mandrel 222. When the satellite riser connector 80 is in locked and mated position, a hydraulic circuit indicated at 227 is completed for control of a fail-safe satellite riser valve located at the buoyant structure 36.

The hydraulic control means for actuating and deactuating stab assembly 72 and for actuating stab assembly connector means 76 at the buoyant structure 36 may include an accumulator 263, FIG. 21, mounted on frame 72a of the stab assembly. Accumulator pressure charging lines 264 extend from the accumulator to each of the pod receptacles 250, each line 264 being provided with a check valve 265 to restrict flow direction to the intended receptacle 250. Accumulator 263 is also connected to a pressure actuated accumulator control valve 267 associated with shuttle valve manifold 261 for controlling the hydraulic pressure for operating the stab assembly connector means 76. Such hydraulic control of the connector means 76 provides quick response in controlling the connector.

The control lines 262 leading from the shuttle valve manifold 261 are best seen in FIGS. 16–20, inclusive. Hydraulic control lines 260 and 262 may be carried beneath the circumferential margin of plate 245 radially outwardly of satellite receptacles 244 in a protected position as indicated at 269, FIG. 18. At spaced intervals along the circumference of plate 245, control lines 262 may be dropped for connection to block manifold 229 on riser connector 80. Each block manifold 229 is connected to the satellite riser connector 80 through an elongated window 231 in receptacle 244 for permitting relative movement of riser connector 80 with respect to receptacle 244 for a selected distance. Such relative movement is required because satellite riser connector 80 is connected to the upper mandrel end of satellite riser pipe 180 of the lower riser portion 39.

The control means at the stab assembly also includes umbilical control lines 271 which extend from the upper plate 245 upwardly to the support plate 70. Umbilical line 271 extends through support plate 70 at a suitable port 272 and is manifolded circumferentially inwardly of the circularly arranged satellite riser pipes in an annular recess 273 provided on the top of support plate 70. From such a manifold as indicated at 274, control lines 275 may extend upwardly to block manifolds 276 provided with a connection to satellite riser connector 71.

As best seen in FIG. 17, receptacle tube 244 for each of the satellite riser connectors 80 is provided with an internal radially inwardly extending collar 280 located intermediate ends of the tube 244. Above riser connector 80 the flexible transfer hoses 78 for the satellite riser pipes 61 may be provided with a collar 281 having an outer diameter greater than the inner diameter of the internal collar 280. Under some conditions of operation, the relative movement of the lower satellite riser pipe 180 with respect to the receptacle tube 244 may be such that collar 281 will seat upon collar 280 and limit such relative movement and at the same time provide support for the satellite riser pipe 180. Collar 281 is also confined between top plate 245 and collar 280 on the receptacle tube and after assembly in the receptacle tube 244, the flexible hoses 78 will not become disassembled therefrom when the stab assembly is disconnected from the upper buoyant structure.

Stab assembly 72 also includes tubular receptacles 248 in diametrical relation in frame 72*a* for reception of control umbilical lines which are lowered from the platform and pass through the stab assembly and buoyant structure for connection to the manifold base means 31. The umbilical lines may be run from a constant tension winch on the platform deck and include control lines for actuation of fail-safe valves at the base means 31.

FLEXIBLE UPPER RISER PORTION (FIGS. 5 AND 6)

Figure 5:
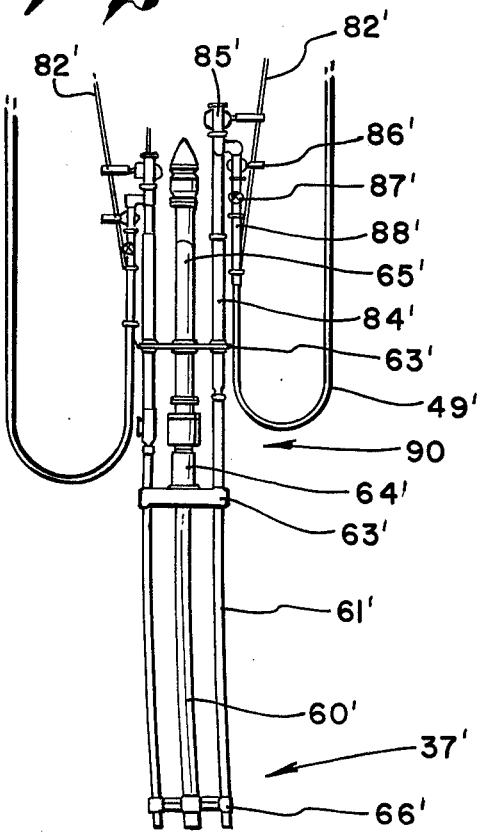
FIG. 5 is a fragmentary elevational view similar to FIG. 3 showing a different embodiment of the upper riser portion.
Figure 5:
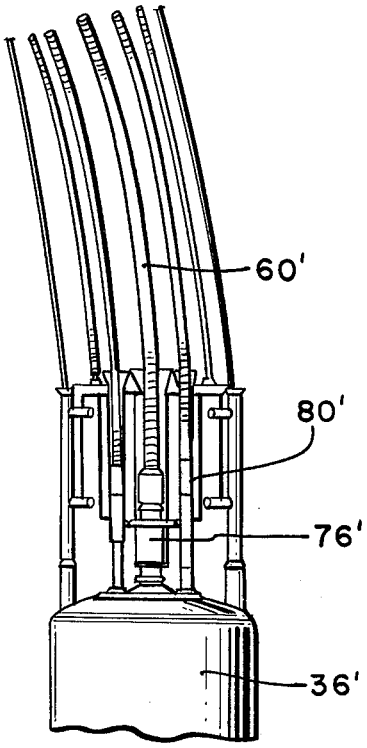
Figure 6:
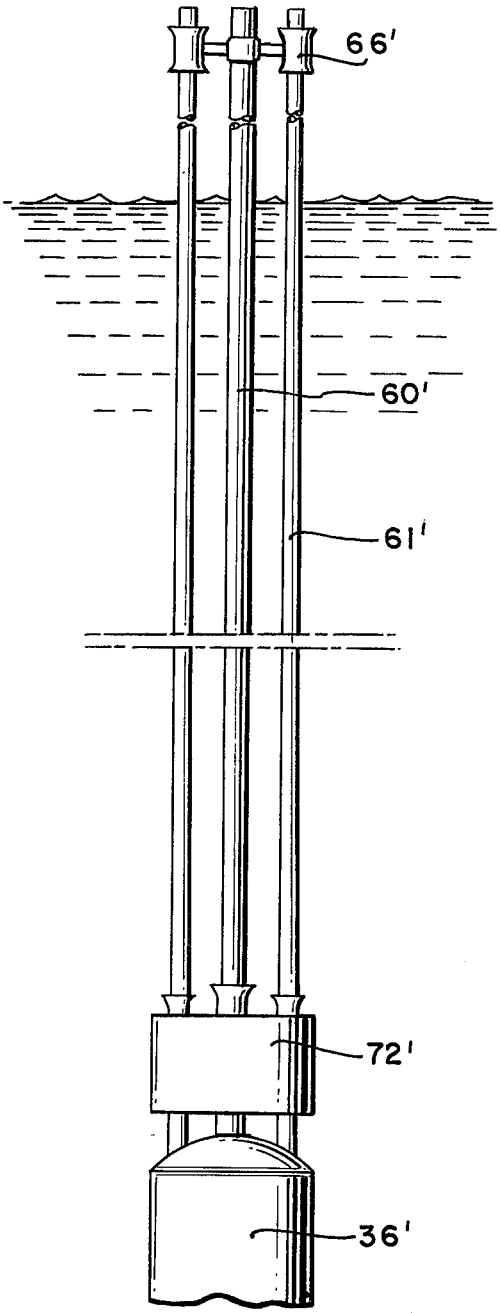
FIG. 6 is a fragmentary elevational view of the upper riser portion shown in FIG. 5.

A different embodiment of upper riser portion 37 is indicated in FIGS. 5 and 6 wherein instead of using rigid steel pipe for the central riser and the satellite riser pipes, flexible hoses are used. In the discussion of this embodiment, like reference numerals with a prime sign will be used for like or similar parts.

Thus, in FIG. 5, upper riser portion 37′ includes a central riser hose 60′ carried by and supported from termination plate 63′. Circularly arranged around the central riser hose 60′ are a plurality of satellite riser hoses 61′, each of said riser hoses 61′ being supported and suspended from termination means including upper and lower plates 63′. At suitable spaced vertical intervals, the central riser hose 60′ and the plurality of satellite riser hoses 61′ may be provided with a spaced guide means 66′ which maintains flexible hoses 60′ and 61′ in spaced relation and in angular orientation with respect to the central riser hose 60′. At the upper end of the upper riser portion 37′ and above lower termination plate 63′, central riser hose 60′ is connected to a central riser connector 64′ carried by lower plate 63′. Above connector 64′ is a compensating assembly 90, which interconnects connector 64′ and standpipe 65′. The termination is carried and supported in a manner similar to that of the prior embodiment as by winch lines 82′ connected to constant tensioning winches carried by the deck structure. Each of satellite riser hoses 61′ is connected to a compensating cylinder means 84′ and to a swab valve 85′, a shut-off valve 86′, a choke means 87′ and a blast joint 88′. The blast joint 88′ is connected to jumper hoses 49′ for conducting fluid to processing equipment on the platform.

At the lower end of upper riser portion 37′, satellite riser hoses 61′ and central riser hose 60′ are connected to a stab assembly 72′ having a frame, guide tubes, and control equipment similar to that described for assembly 72. Central riser hose 60′ is provided with a stab assembly connector 76′ for connecting to the central riser pipe of the lower riser portion through the buoyant structure 36′. Each of the satellite riser hoses 61′ is connected to a satellite connector means 80′ in the stab assembly 72′. The central riser connector 76′ and the satellite riser connectors 80′ are located in the elongated upstanding guide tubes having upper bell mouth openings to minimize stress on the hoses at their point of entry in the guide tubes of stab assembly 72′.

In this modification of upper riser portion 37′, it should be noted that central riser hose 60; and stab assembly 72′ are supported by central riser hose 60′ from termination plates 63; and from supporting constant tension winch lines 82′. Central riser hose 60′ is subjected to a tensioning force exceeding the weight of riser portion 37′ and stab assembly 72′ so that the weight of upper riser portion 37′ does not rest or bear upon the buoyant structure 36′. The flexible satellite riser hoses 61′ are supported from the compensating cylinders 84′. A nominal tension above the load of individual satellite riser hose 61′ and its connector in the stab assembly is imposed upon the satellite riser hose 61′ so that the weight of each satellite riser hose is never imposed upon the buoyant structure 36′.

BUOYANT STRUCTURE

Figure 7:
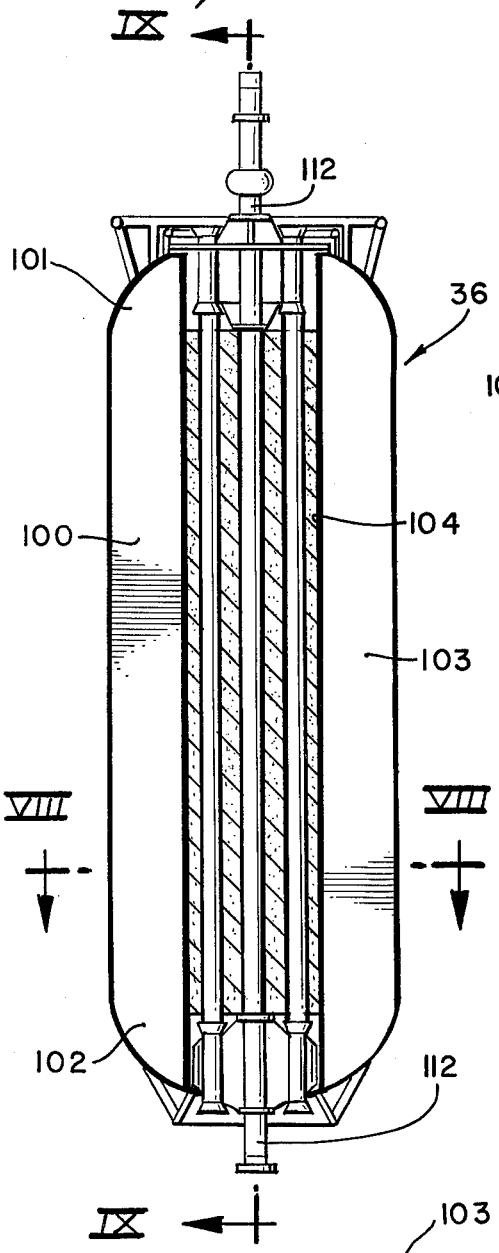
FIG. 7 is an enlarged elevational view, partly in section, of the buoyant structure used in this invention.
Figure 9:
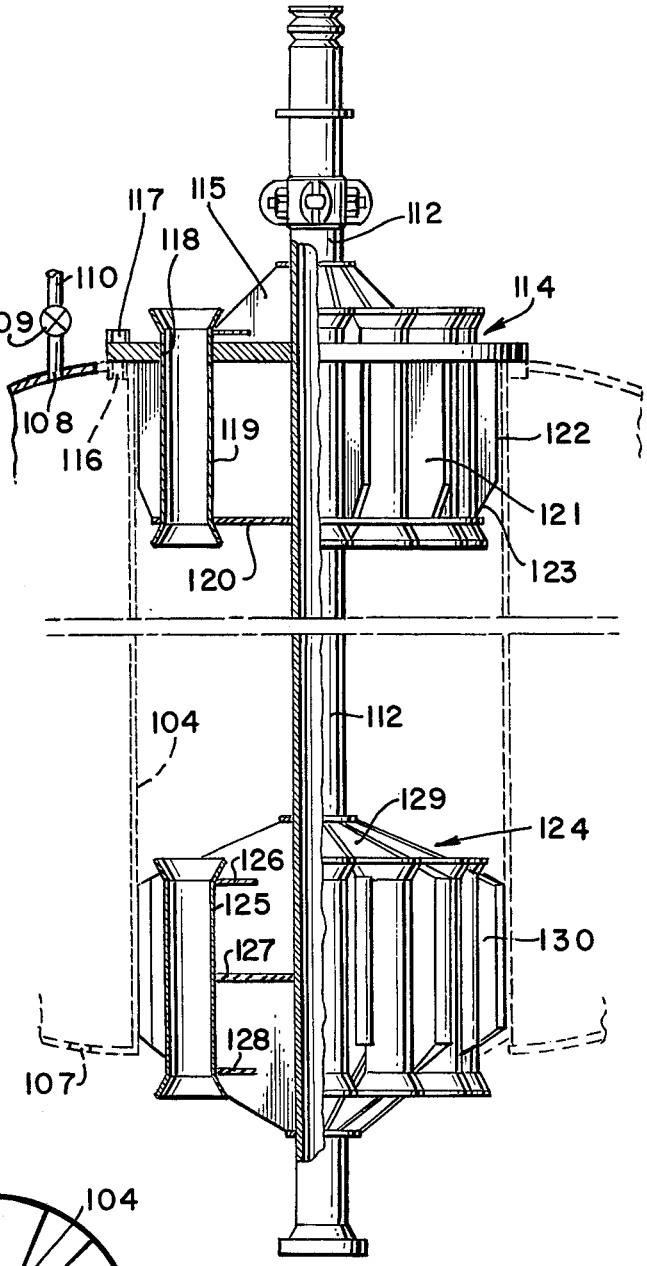
FIG. 9 is an enlarged fragmentary view of the buoyant structure shown in FIG. 7 and partly in section to show more clearly the connection of the riser system to the buoyant structure.
Figure 8:
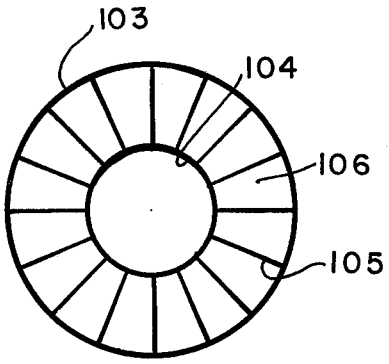
FIG. 8 is a transverse sectional view taken in the plane indicated by line VIII — VIII of FIG. 7 showing ballast compartments.

Buoyant structure 36 (FIGS. 7, 8 and 9) provides means for applying tension to the top of lower riser portion 39 and also provides means cooperable with stab assembly 72 (or 72′) for supporting the upper end of lower riser portion 39 when upper riser portion 34 is released from buoyant structure 36 and lower riser portion 39 by disconnecting stab assembly 72. Buoyant structure 36 also serves as a means facilitating interconnection of upper riser portion 37 and lower riser portion 39. When buoyant structure 36 and lower riser portion 39 are disengaged from upper riser portion 37, the buoyant structure 36 is effective, together with buoyant means associated with the central riser pipe and satellite riser pipes of the lower riser portion to permit the lower riser portion and buoyant structure to be free-standing in the water. In addition, the shape of buoyant structure 36 is designed to minimize the effect of hydrodynamic forces acting thereon and on lower riser portion at a selected depth in water, maximizing the volumetric efficiency of the buoyant structure, and permitting lower riser portion 39 and buoyant structure 36 to be effectively operable under varying operating modes and environmental conditions.

In this example, buoyant structure 36 comprises an elongated, hollow body 100 having generally semi-spherical top and bottom body ends 101 and 102. Hollow body 100 comprises an outer cylindrical wall 103 and an inner cylindrical wall 104 which provides a through axial opening in body 100 for reception and passing therethrough of upper ends of the central and satellite riser pipes of the lower riser pipe portion 39. A plurality of angularly spaced radially extending partition walls 105 extend between inner wall 104 and outer wall 103 to provide a plurality of adjacent, separate, independent ballast or buoyant chambers 106. At the bottom of each chamber 106 may be provided a flooding port 107 and at the top of each chamber 106 may be provided a vent opening 108 having a vent valve 109. Vent lines 110 of each chamber 106 may be connected to a common manifold (not shown) having stop valves (not shown) for flow of pressure gas during ballasting and deballasting of the buoyant structure. A suitable pressure gas is nitrogen, compressors or nitrogen generators, and accumulators may be provided on the platform for connection to the buoyant structure through suitable hoses, (not shown). Chambers 106, in this example, are not provided with buoyant material.

Means are provided for guiding and centralizing the central and satellite riser pipes which pass through the axial opening provided in buoyant structure 36. Such means comprises a rigid, axially disposed central pipe 112 having top and bottom ends projecting beyond the ends of the body 100. Secured and fixed to the top portion of connector pipe 112 is a guide and alignment means, generally indicated at 114, which comprises a top circular support plate 115 having edge portions extending over the end of hemispherical end portion 101 of body 100 for securement to a reinforced inner circumferential flange 116 by a plurality of securement bolts 117. Support plate 115 has a plurality of circularly arranged openings 118 within which may be received and secured a plurality of guide funnels 119 spaced in accordance with the spacing of the satellite riser pipes of the riser pipe system. The lower end of each guide funnel 119 may be suitably secured as by welding to a lower circular plate 120. The guide means 114 also includes a plurality of radially, vertically extending walls 121 interconnecting plates 115 and 120. Each wall 121 has an outer edge 122 parallel to the axis of pipe 112 and spaced from said axis to provide loose tolerance with the inner surface of the inner wall 104 of the buoyant structure. The lower end of each wall 122 may be inclined inwardly at 123 to facilitate reception of guide means 114 into buoyant structure 36.

A centering means 124 is fixed to center pipe 112 adjacent the bottom of the through opening in buoyant structure 36. Centering means 124 comprises a plurality of circularly arranged funnels 125 to pass satellite pipes therethrough. Funnels 125 are supported from central pipe 112 by vertically spaced plates 126, 127 and 128 and vertically disposed walls 129 which extend between plates 126, 127, 128 and are provided with inwardly inclined top and bottom edges to facilitate guidance of the centering means 124 into and out of the buoyant structure opening. At the outer edge portion of each wall 129 vertically extending, elongated, resilient members 130 are provided to bear against the inner surfaces of wall 104 without attachment thereto.

The connection of guide means 114 to the buoyant structure 36 is subjected to bending moments and cyclic loads transmitted by the buoyant forces of the buoyant structure to the riser pipe system. The bolted flange connection for support plate 115 to the buoyant structure is adapted to transmit direct tension loads and also moment and shear loads. Bending forces acting on the lower riser portion which might produce axial misalignment of central pipe 112 with respect to the axis of the buoyant structure will be cushioned and restrained by the centering means 124 and the longitudinally extending resilient pads 130 carried by each of the walls 129.

It should be noted that the large number of chambers 106 provided in buoyant structure 36 limits the extend of unintentional flooding of a chamber caused by an external collision with the buoyant structure, malfunction of the ballast system, or loss of pressure due to corrosion. In addition, chambers 106 are designed to remain permanently dry and may be filled with dry nitrogen. Corrosion is thus resisted because of the lack of oxygen. In addition, surfaces of the buoyant structure are coated with corrosion resistant paints and an impressed current system of cathodic protection may also be provided.

LOWER RISER PORTION

Figure 10:
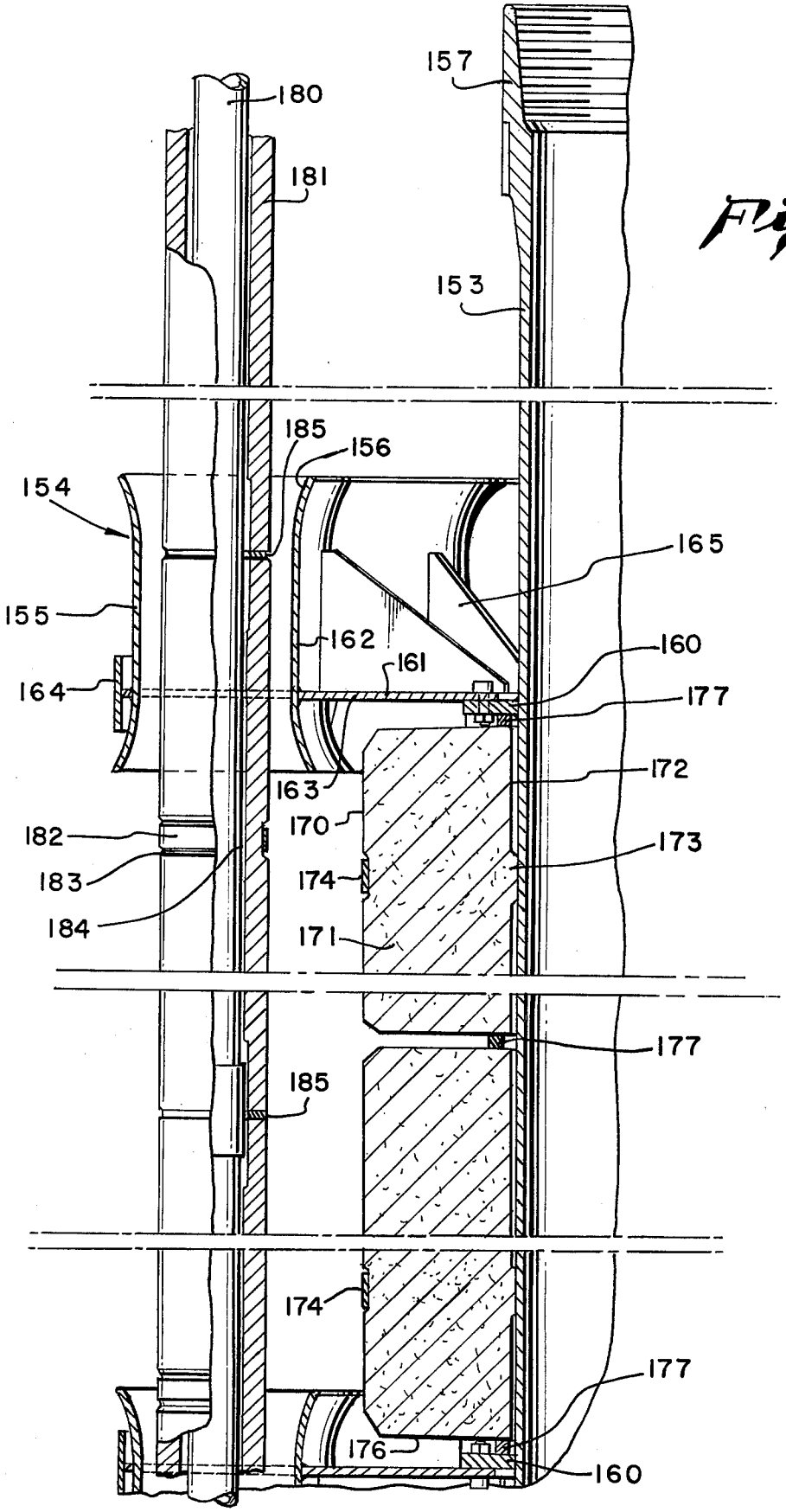
FIG. 10 is an enlarged fragmentary sectional view showing a portion of the lower riser system.
Figure 11:
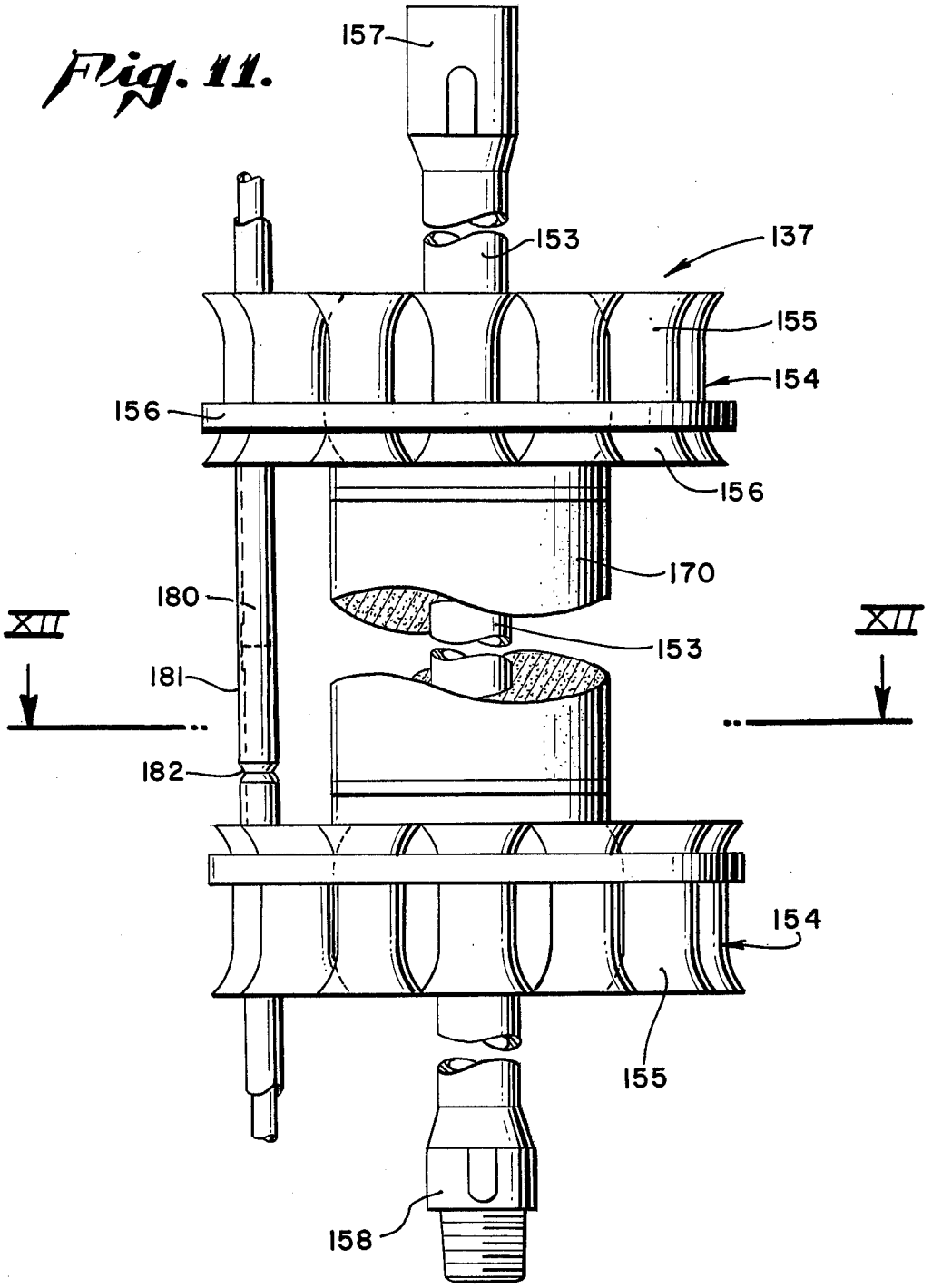
FIG. 11 is an elevational view, partly in section, showing the arrangement of guide funnels and support from the central riser of the lower riser portion.
Figure 12:
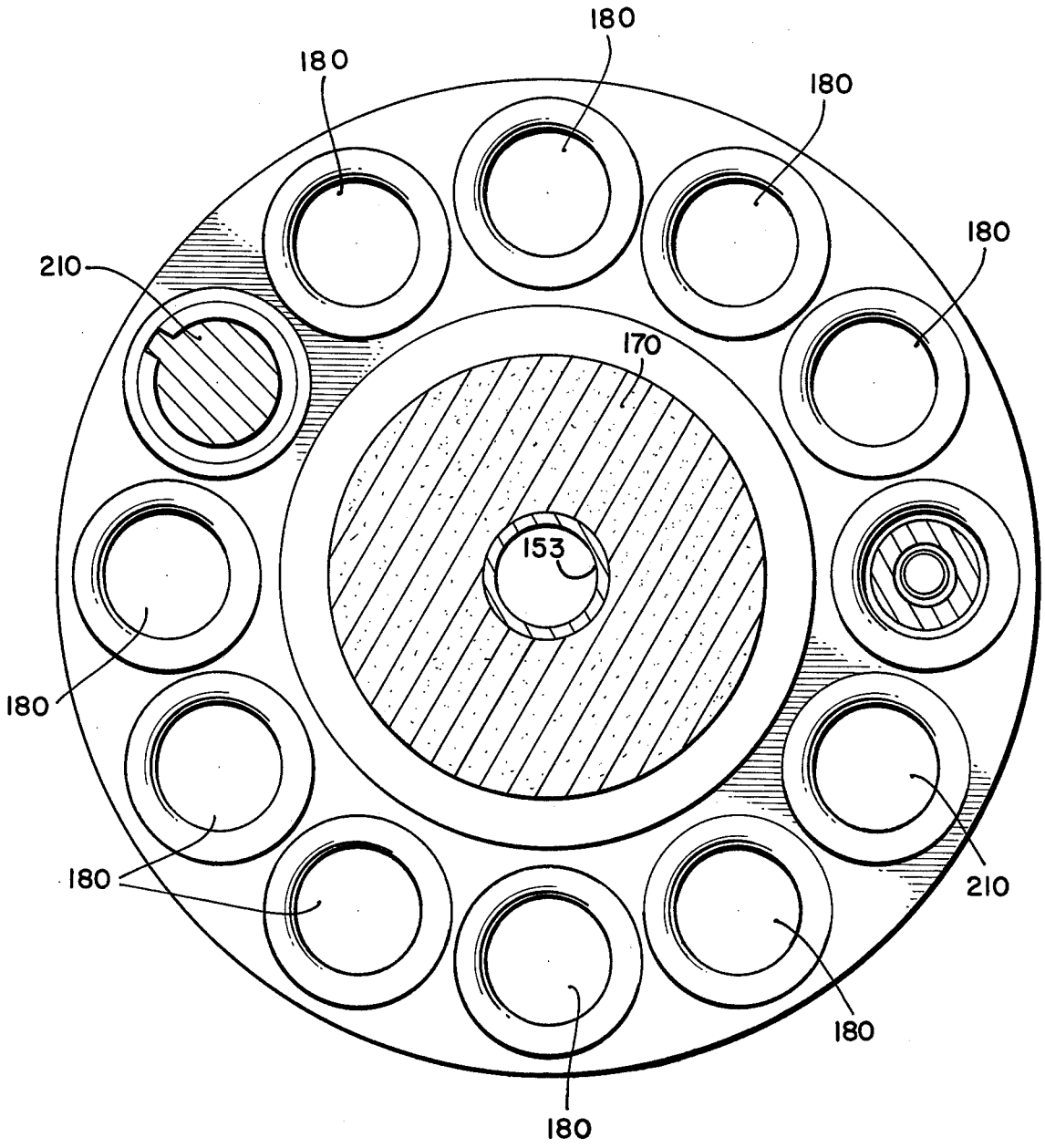
FIG. 12 is a transverse sectional view taken in the plane indicated by line XII — XII of FIG. 11.
Figure 13:
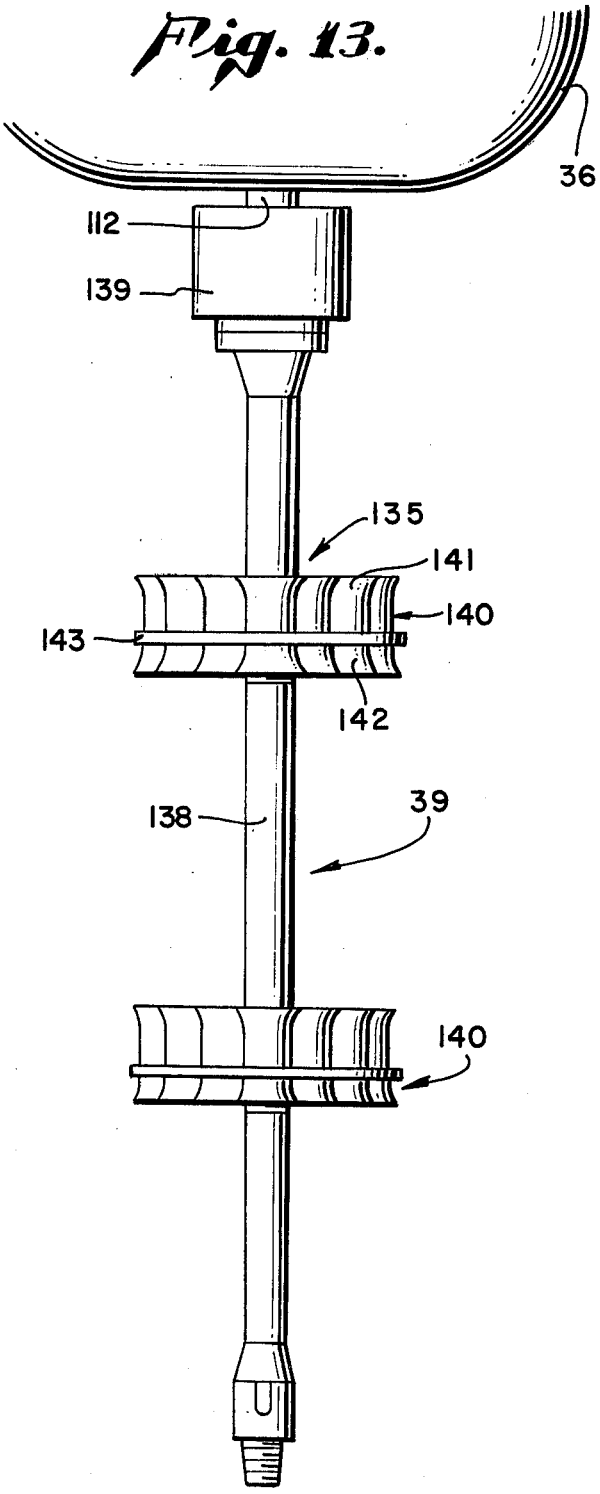
FIG. 13 is a fragmentary elevational view showing the lower riser portion extending downwardly from the buoyant structure.
Figure 14:
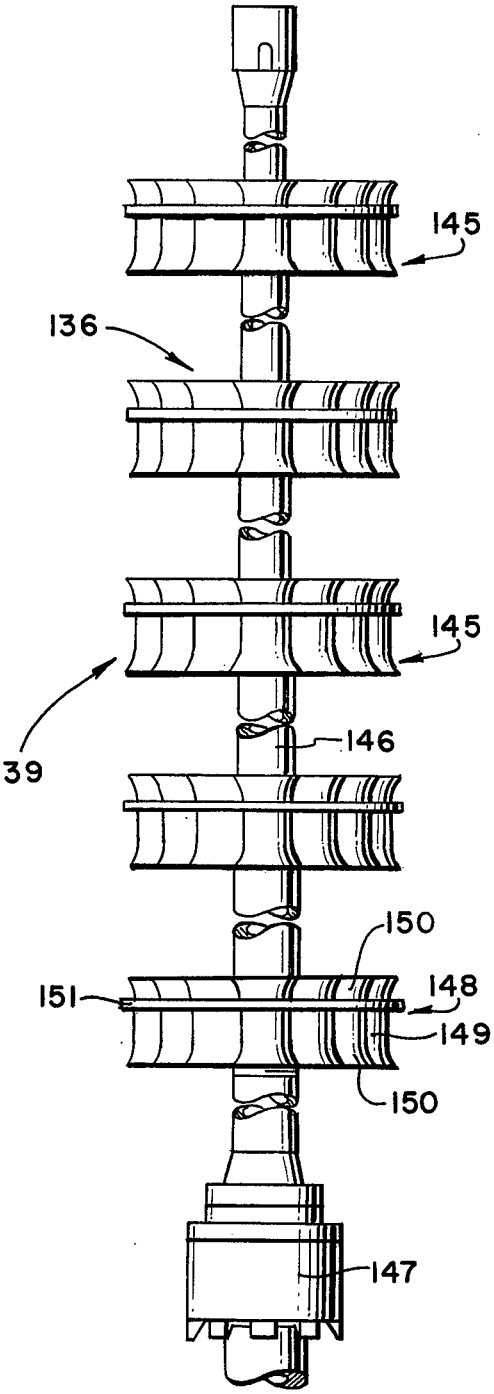
FIG. 14 is a fragmentary elevational view of the lower riser portion adjacent the manifold base means.

Lower riser portion 39 is shown in detail in FIGS. 10–14. Referring first to FIGS. 13 and 14, FIG. 13 shows upper end section, generally indicated at 135, of lower riser portion 39 and FIG. 14 shows lower end section 136 of lower riser portion 39. FIG. 11 illustrates a typical lower intermediate riser section 137 which extends between the upper and lower sections 135 and 136 of the lower riser portion 39.

Upper riser section 135 comprises an elongated, downwardly tapered, central riser pipe 138 carrying at its top end a suitable riser connector 139 for connecting to central riser pipe 112 supported from buoyant structure 36. Intermediate ends of tapered pipe 138 are a plurality of spaced satellite riser pipe guide means 140, each comprising a plurality of circularly arranged guide cylinders 141 having ends provided with outwardly flaring bell mouths 142. Guide cylinders 141 are interconnected and supported by a circular plate 143 secured to central riser pipe 138 in a manner similar to that shown in FIG. 10 as later described.

The lower riser section 136 of lower riser pipe portion 39 is constructed in similar manner. At the lower end of an upwardly tapered pipe section 146 is provided a riser connector means 147 for connection to the base manifold means, as later described. At spaced vertical intervals along the upwardly tapered pipe 146 are a plurality of satellite pipe guide means 148, each comprising a plurality of circularly arranged cylinders 149 having bell mouth ends 150. Cylinders 149 are supported from a circular plate 151 having a connection to the tapered pipe 146 in a manner as shown in FIG. 10 as hereafter described. Between the upper and lower tapered pipes 138 and 146 may be provided a lower riser pipe section 137 comprising a cylindrical pipe 153 having supported therefrom satellite pipe guide and alignment means 154 of a construction similar to the guide means 140 and 148 of FIGS. 13 and 14. Each of the cylindrical members 155 has bell mouthed ends 156. The cylinders 154 are supported from a plate 156, the structure of guide means 154 being described in detail with reference to FIG. 10.

In FIG. 10, riser pipe 153 includes top and bottom tool joint connecting ends 157 and 158. At spaced intervals along the length of pipe section 153 may be provided annular flanges 160. Bolted to each flange 160 is a circular plate 161 having a plurality of circular openings 162 therein for reception of cylinders 155 and for the welding thereto as at 163 of said cylinders. Radially outwardly of the cylinder support plate 161 includes a cylindrical flange 164 for reinforcement of the outer circumferential edge portion of circular plate 161. Cylinders 155 are further supported by triangular gusset plates 165 welded to the exterior surface of cylinders 155 and to plate 161. A rigid guide funnel means 154 is thus fixedly carried by the central riser pipe section 153. Guide cylinders 155 of adjacent guide funnel means 154 are coaxially aligned, such alignment of the funnel guide means being facilitated by suitable reference indicia provided on the guide means and on the pipe sections.

The securement of guide funnel means 140 and 148 on upper and lower tapered pipes 138 and 146 is similar to that described above and it will be understood that from buoyant structure 36 to base manifold means 31 all of the guide funnels or cylinders of the guide means are in axial alignment for continuous linear passage therethrough of satellite riser pipes.

BUOYANCY MEANS — LOWER RISER PIPE PORTION

Means providing selected positive buoyancy of lower riser pipe portion 39 is shown in FIGS. 10 and 11. Central riser pipe sections and satellite riser pipes in lower riser portion 39 are encapsulated with buoyant elements which serve to assist stabilization of the riser system under severe current and wave conditions and to assure that under lightest expected operating conditions the lower riser portion 39 does not become positively buoyant. The buoyancy of the central riser pipe sections and the satellite riser pipes in the lower riser portion 39 are arranged to permit sufficient weight in water of the riser pipes to enable them to be readily installed.

An exemplary central riser pipe 153 includes a plurality of cylindrical buoyant members 170, each formed of two semi-cylindrical parts 171. Each buoyant member 170 includes a generally cylindrical internal surface 172 having an inner diameter slightly greater than the outer diameter of riser pipe 153. Centrally between ends of each buoyant member 170, the inner surface 172 is provided with a spacer rib 173 to maintain an annular space between buoyant member 170 and riser pipe 153. Spacer rib 173, because of its small axial area of contact with central riser pipe 153, substantially eliminates transmittal of bending stresses from the riser pipe 153 to buoyancy members 170. Buoyancy members 170 are secured about riser pipe 153 by a suitable external band 174 which may be tightened within an external annular groove formed on the exterior surface of buoyant member 170 approximately opposite internal annular rib 173. Preferably, band 174 may be made of corrosion proof material, such as a Kevlar fiber based strapping band.

A plurality of buoyancy members 170 are axially positioned on riser pipe 153 by spaced guide funnels 154. Between end surface 176 of each end buoyant member 170 and annular rib 160 on the pipe section 153 may be provided a buffer or cushioning ring 177 to prevent transmission of bending stiffness from the buoyant member to the guide funnel support flange 160. A similar buffer ring 177 is provided between adjacent buoyant members. Buffer rings 177 may be made of suitable elastomeric material.

Buoyant members 170 may be made from a vacuum molded syntactic foam material encased or covered with a fiber glass outer hard skin or shell. An exemplary foam density is 28 lbs. per cubic foot which provides a buoyancy of about 36 lbs. per cubic foot when immersed in sea water. Lower riser portion 39 will vary in length depending upon the depth of the water and will considerably exceed the length of upper riser portion 37 which may usually be approximately 300 feet. For example, the lower riser portion 39 may vary from a few hundred feet to a few thousand feet. The requirements of the buoyant support of the central riser pipe of the lower riser pipe portion 39 will vary and, in some instances, buoyant members 170 may not extend continuously from buoyant structure 36 to the base manifold means 31.

Each satellite riser pipe 180 of lower riser portion 39 extends continuously from buoyant structure 36 to the base manifold. Each satellite riser pipe 180 may be somewhat similarly covered or encapsulated with cylindrical buoyant members 181 made of a similar premolded syntactic foam material as that of members 170. The cylindrical buoyant members 181 may be secured by Kevlar strapping 182 received within annular grooves 183 provided opposite spacer or buffer rings 184 in a construction similar to that of buoyancy members 170. Annular rings 185 of elastomeric material may be interposed between ends of adjacent buoyant members 181 to prevent or minimize the transmission of bending stiffness from one buoyant member to an adjacent buoyant member. The rings 184 serve the same purpose as rings 173 on the central riser to avoid stiffening of the satellite risers. The material of the buoyant members 181 is similar to that of buoyant members 170. Buoyant members 181 may be axially positioned by a molded polyurethane ring bonded to satellite riser pipe 180. Buoyant members 181 are preferably arranged to extend continuously from buoyant structure 36 to the base manifold means 31. Buoyant members 181 provide continuous buoyant support for satellite pipe 180 and since it extends for the entire length of the riser pipe 180, the cross section of buoyant members 181 may be reduced so that only a sufficient amount of buoyant foam material is used to achieve the desired buoyant force. In addition, the continuous encapsulation of satellite pipe 180 in buoyant members 181 provides a generally continuous cylindrical surface on the satellite riser pipe of the lower riser portion 39 so that movement of each satellite pipe through the plurality of guide funnel assemblies 154 is facilitated. The shell or skin material of buoyant members 181 is similar to that of members 170, such reinforced fiber glass material serving to protect the riser pipe against severe blows without crushing or cracking of the shell or skin.

Satellite riser pipes of the riser pipe system carry high pressure fluid from the seabed to the platform, such exemplary pressures typically ranging as high as 7000 psi. Structural stresses including static and dynamic stresses in the satellite riser pipes caused by bending of the lower riser pipe portion are relatively low compared to stresses imparted to the riser pipe by the high pressure fluid flowing therethrough. It should be noted that the provision of vertically spaced guide funnel assemblies through which the satellite riser pipes pass prevent the satellite riser pipes from buckling and possible failing. Sufficient integral buoyancy is provided for each satellite riser pipe so that very little auxiliary top tension is required. Each satellite riser pipe can be handled as a regular oil well string and may be run through the aligned guide funnel assemblies, either for installation or for retrieval.

MANIFOLD BASE MEANS

Figure 15:
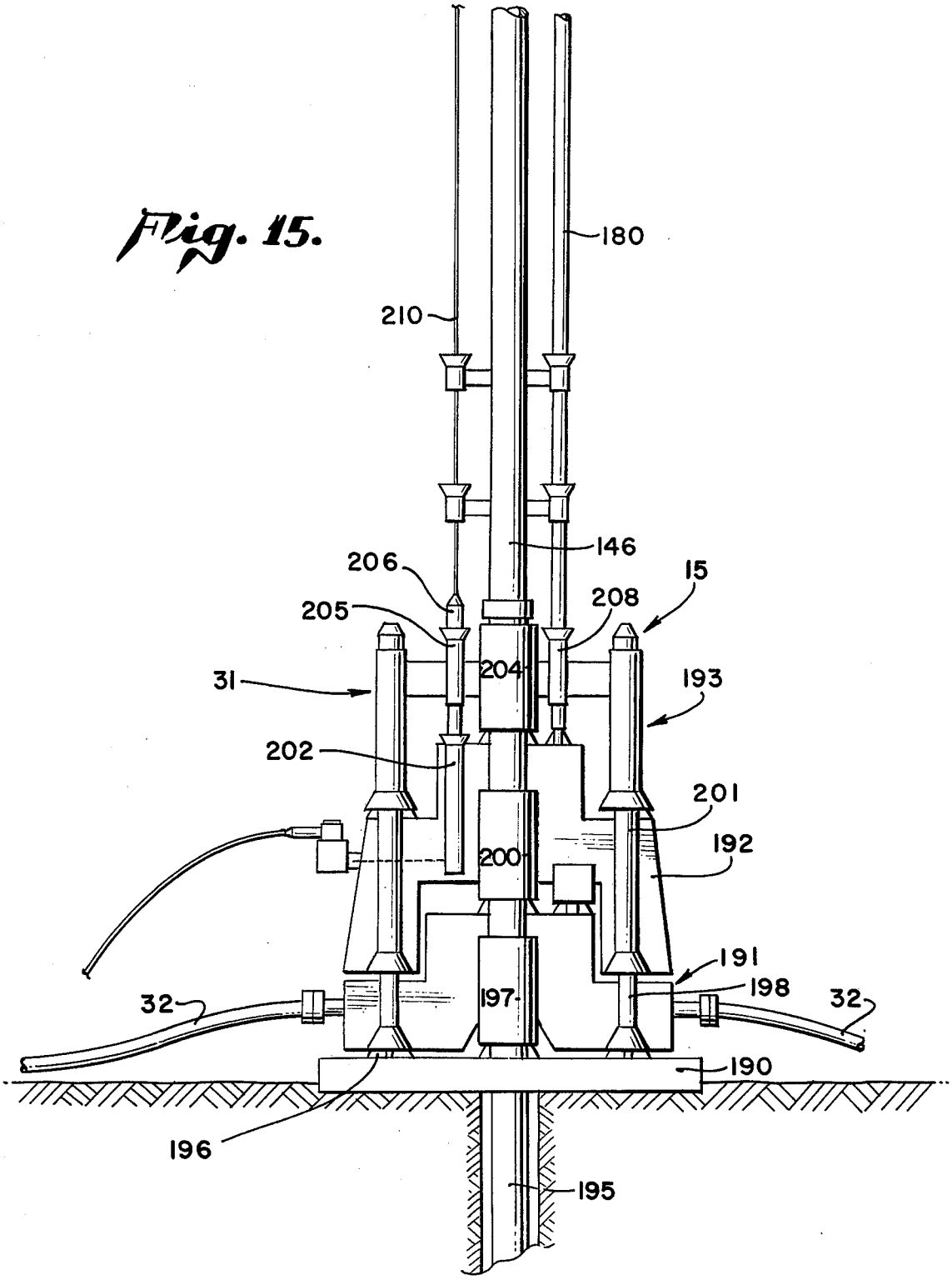
FIG. 15 is a fragmentary elevational view of the manifold means at the seabed in operational condition.

Production manifold base means 31 is schematically shown in FIG. 15. Manifold base means 31 comprises an anchor base 190, a permanent manifold means 191 seated on anchor base 190, a removable manifold 192, and a lower riser connector assembly 193.

Anchor base 190 may comprise a polygonal base provided with a depending pile 195 adapted to be cemented in the hole drilled for the pile. The anchor base 190 may be filled with cement after it has been installed and oriented and positioned in desired relationship with flowlines 32. Anchor base 190 includes a plurality of spaced guide posts 196, which extend upwardly for a selected distance in order to receive guide funnels of permanent manifold 191. Suitable guidance means such as an acoustic beacon may be used to facilitate orientation of anchor base 190 on the sea floor.

Permanent manifold means 191 is designed and arranged to preclude maintenance and service for long periods of time, and to be permanently installed on the anchor base. Permanent manifold means 191 may include a marine connector 197 and guidance means 198 for cooperation with the anchor base guide posts 196. Permanent manifold means 191 includes the necessary equipment for connecting flowlines 32 thereto and for transmitting fluid conducted therein to satellite riser pipe production lines and also from the central riser processed fluid line. Such equipment may include hydromechanical isolation valves of safety type wherein hydraulic pressure fluid maintains such valves in open position and in the event of a hydraulic fluid failure such valves are mechanically closed. Such valves may also be operable to closed position upon removal of the removable manifold 192.

Permanent manifold means 191 may also include a selected number of manifold flowline mandrels, each adapted to act as the receptor for one or more wells and to provide lock and seal means between the removable manifold 192 and permanent manifold 191.

Removable manifold 192 is guidably receivable on the guide posts of the permanent manifold and includes a marine connector 200, guidance means 201, a hydraulic probe receptacle 202, manifold flowline connectors and production, service, and bypass valves, as well as upstanding mandrels for cooperation with connector means on the central riser pipe and the satellite riser pipes.

The lower riser connector assembly 193 provides a means for direct connection between removable manifold 192 therebelow and the lower ends of the lower riser pipe portion 39. Connector assembly 193 includes a hydraulically actuated marine connector 204 for connection to the lower tapered central riser pipe 146, said connector 204 receiving and mating with connector 147. The lower connector assembly 193 also includes guide tubes 205 (only one shown in FIG. 15) for reception of control probes 206 adapted to be lowered through buoyant structure and through the guide funnel assemblies of lower riser portion 39 to manifold base means 31.

The marine connectors 197, 200 and 204 carried by the manifold means 191, 192 and lower assembly 193, respectively, provide a rigid axially aligned structure at the base means. The connector of central riser pipe 146 to connector 204 provides communication of processed fluid from the central riser to the associated seabed transfer line 32.

Satellite riser connectors (not shown) are provided at the end of each of the satellite riser pipes 180. Since satellite riser pipes 180 are not rigidly fixed to lower riser portion 39 and pass freely in guide funnel assemblies 154, the satellite pipes 180 may be made up on individual satellite riser strings and lowered to the buoyant structure, positioned in the guide funnels, and then lowered to the lower riser connector assembly 193 where each satellite connector received in a guide 208 is stabbed over its corresponding mandrel carried by removable manifold 192.

The above description of the manifold base means has not been detailed because the arrangement of connectors, valves, and electrical and hydraulic lines thereto for operation may be any suitable arrangement of such equipment. It is important to note, however, that the anchor base 190 and the permanent manifold 191 is designed to be as trouble free as possible and to remain on the seabed for long periods of time without requiring service or maintenance. Removable manifold 192 and lower riser connection assembly 193 may be retrieved and upon such retrieval safety valves in the base manifold will be actuated to close off flowlines.

CONTROL MEANS

Control means for operation of the connectors, valves, and other equipment at the base manifold means 31 and equipment at the satellite subsea wells is provided by two control probes 206, only one of which is shown in FIG. 15, one of said control probes being redundant and operable in the event the other control probe fails. Control probes 206 provide hydraulic power to the valves of the recoverable manifold and to the satellite subsea wells, and electric power and signals to equipment on the manifold and to the satellite subsea wells. Each control probe also includes a receiver transmitter for reception and transmission of multiplex signals from/to the platform to/from equipment inside each probe on the manifold and to/from on the satellite subsea wells. The control probe 206 also includes power for locking and unlocking connectors for release of the central riser 146 and the satellite risers 180. Each control probe provides at its base a hydraulic and electrical connection to distribute hydraulic power and electrical power and signals.

Each control probe 206 is carried by an umbilical line 210, lines 210 being diametrically opposite and serving as a tension and tethering line for the buoyant structure 36. For this purpose umbilical tethering lines 210 are designed to accept tension loads and may be slightly negatively buoyant in water. When control probe 206 is locked in the base manifold means 31 and tension on the umbilical line is released from the platform during running in of the control probe, the buoyant structure is loaded by the weight in water of the umbilical lines 210.

Figure 3:
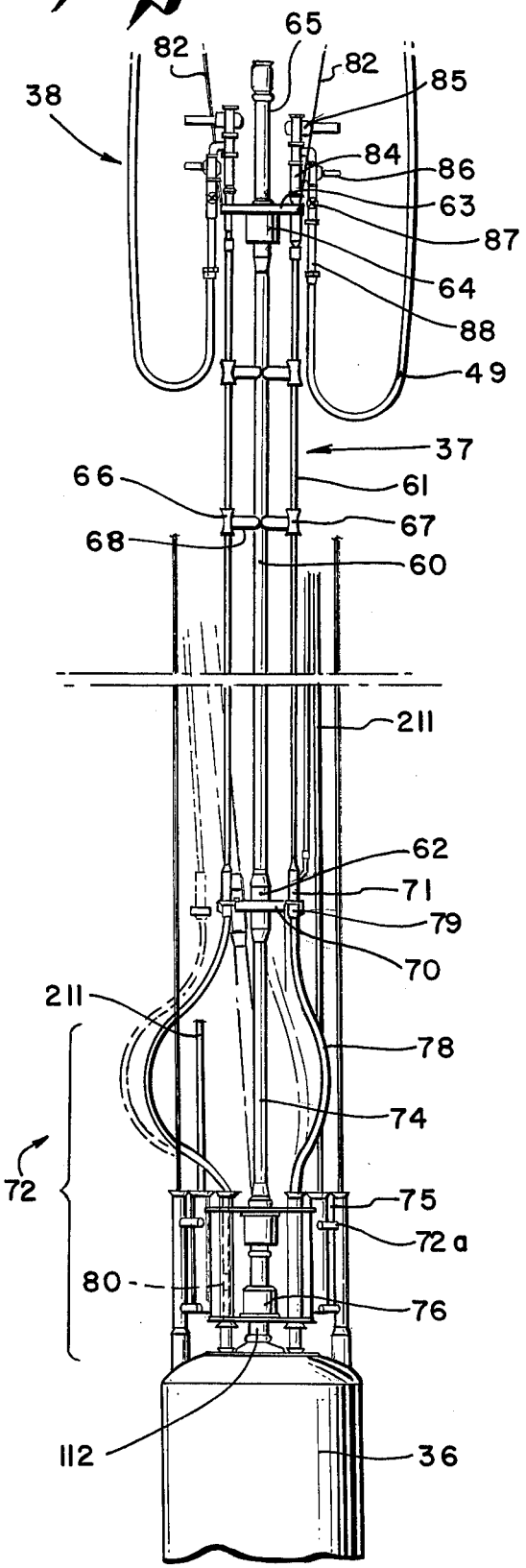
FIG. 3 is a fragmentary side elevational view illustrating one embodiment of a riser connection to a termination plate provided at the floating platform and also illustrating connection of the riser to the upper portion of the submerged buoyant structure.
Figure 4:
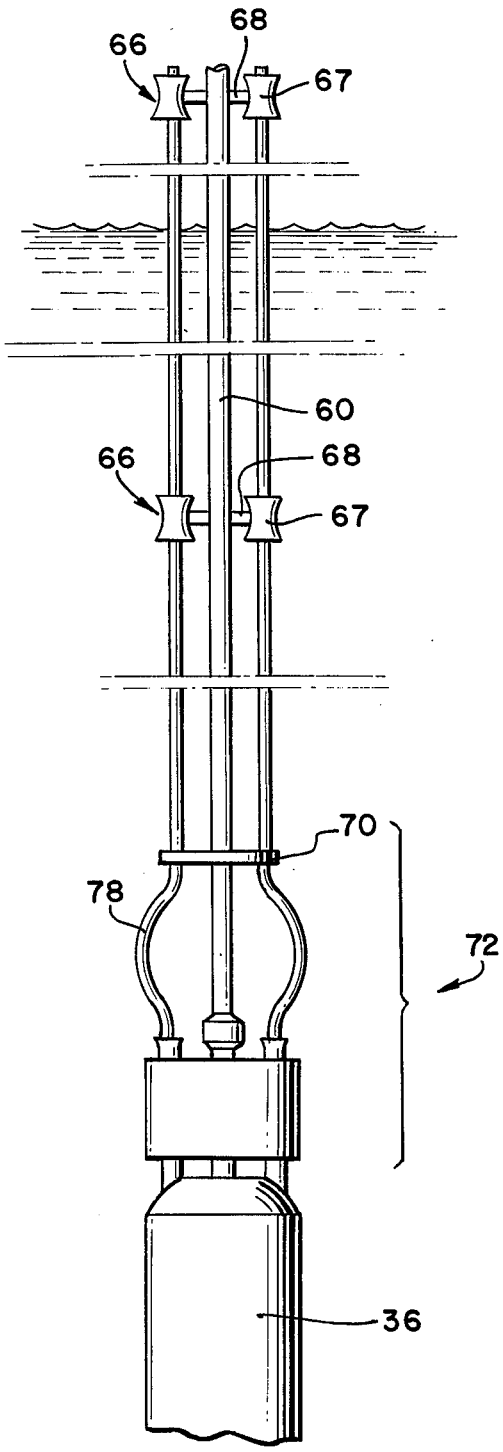
FIG. 4 is an elevational view showing the upper riser portion of the riser system of this invention in which the upper riser portion includes rigid riser pipes.

The lower umbilical lines 210 are provided with a means for quickly disconnecting the umbilical lines 210 associated with the lower riser portion 39 from the upper umbilical lines 211, one of which is indicated in FIG. 3. The quick disconnect is provided at the stab assembly 72 at the buoyant structure 36. Upon disconnection at the buoyant structure 36 it is understood that all of the base valves at the base manifold means 31 are automatically closed. The upper umbilical line 211 is relatively short, for example 300 feet, and has a minimal surface tensioning load. The upper umbilical control line 211 may include hydraulic pressure lines for control of the umbilical connector means at the stab assembly at the buoyant structure 36.

Each satellite riser connector 80 is connected to a block manifold 229 to permit control of the connector from the platform. The block manifold is connected to the receptacle 222 by a shear bolt 230 which may be sheared if it becomes necessary to release a satellite riser pipe without disconnecting the central riser. Unless the stab assembly 72 is to be retrieved, reconnection of the block manifold is made by a diver. In FIG. 17 the satellite riser connector 80 is shown within a receptacle tube 72*a*, the receptacle tube being provided with a window at 231 for reception of the manifold 229.

The marine production riser system described above contemplates a riser system which is readily adaptable to the control and operation of a plurality of satellite subsea wells at great depths in water. Since the riser system comprises an upper riser portion of preselected relatively shallow depth, such as 300 feet, the characteristics of such upper riser portion may be separately designed so that when disconnected from the lower riser portion the upper riser portion may be readily carried by the platform or vessel. The lower riser portion under such circumstances is capable of standing vertically upward without any assistance from the upper riser portion and provides a means for reentering the well system by reconnecting the upper riser portion thereto at the buoyant structure 36. The riser system provides for automatic shut-off of the production flowlines and other equipment in the event of such rapid disconnect of the two riser portions at the buoyant structure 36.

Further, the marine riser system of this invention provides for the arrangement of a central riser, which serves as a main support and for the arrangement of satellite risers about the central riser, each satellite riser being capable of independent separate maintenance and service. The arrangement of the central riser and satellite risers in the upper riser portion and their connection to the floating vessel at the termination plate provides for a connection to the vessel which is flexible and yieldable so that undue stresses will not be imposed upon the upper connection of the riser system to the platform or vessel. The lower riser system is provided with sufficient buoyany throughout its length and by means of the buoyant structure 36 to minimize stresses therein due to ocean currents and surface waves. The lower riser portion is provided with adequate tension to maintain the lower riser system in upright free-standing position and the buoyant structure 36 is tethered and secured to the base manifold means and anchor so that in the event of failure of the lower riser portion at some point along its length the buoyant structure 36 will not rapidly rise to the surface and collide with the platform.

The base manifold means 31 has been generally described and provides a collection and distribution point for the flow of fluid from the satellite subsea wells and processed fluid to a selected destination. The riser system provides for control means at the base manifold means for controlling equipment thereon and also for controlling equipment at the subsea wells.

It will be understood that other modifications and changes may be made in the marine production riser system described above, and all such changes and modifications coming within the scope of the appended claims are embraced thereby.

We claim:

1. A deep water production riser system comprising in combination:

a floating platform;

a manifold base means on the seabed underneath said platform and including actuating and monitoring equipment for remote wells associated with said base means;

and riser means for conducting hydrocarbon fluids between said base means and said platform;

said riser means including a central riser pipe and a plurality of peripherally spaced satellite riser pipes arranged around said central pipe, said satellite pipes conducting unprocessed hydrocarbon fluids to said platform, said central riser pipe conducting processed hydrocarbon fluid to said manifold base means;

a buoyant structure between said floating platform and said manifold base means and attached to said central riser pipe and cooperably associated with said satellite riser pipes;

said buoyant structure supporting said central riser pipe therebelow and providing guide passageways for said satellite riser pipes to extend therethrough;

means above said buoyant structure for separating central and satellite riser pipe portions above said buoyant structure from the corresponding central and satellite riser pipes below and at said buoyant structure;

and a control means on said platform for actuation and monitoring of equipment on said manifold means and said remote wells and for actuating said separating means;

said buoyant structure and said riser pipes therebelow being self-supporting when separated from the riser pipes above said buoyant structure.

2. A system as stated in claim 1 including tension means at said platform supporting said central riser pipe, the portion of said central riser pipe above said buoyant structure serving as a suspension member supported by said tension means so that at least no downward loading is imparted to said buoyant structure.

3. A system as stated in claim 1 wherein said buoyant structure and the portion of said riser means below said buoyant structure includes means for supporting only said buoyant structure and the portion of said riser means therebelow in vertical position and without the help of the portion of the riser means above the buoyant structure;

the portion of said riser means below said buoyant structure including buoyancy members encapsulating said riser means portion.

4. In a system as stated in claim 1 including means at said separating means and means at said platform providing for removal of each satellite riser pipe independently of the remaining satellite pipes.

5. In a riser system as stated in claim 1 wherein said buoyant structure includes an inner elongated cylindrical shell, an outer elongated cylindrical shell coaxial with said inner shell, said riser means extending through said inner shell, and means at opposite ends of said inner shell for coaxially aligning said riser means with said inner shell, said aligning means including means for attachment of said buoyant structure to said central riser pipe of said riser means.

6. In a riser system as stated in claim 5 including resilient guide paths on said alignment means for engagement with said inner shell.

7. In a system as stated in claim 5 including
a plurality of circularly arranged guide funnels on said alignment means for passing said satellite riser pipes through said buoyant structure.

8. In a riser system as stated in claim 5 including a plurality of longitudinally extending ballast chambers between said inner and outer shells.

9. In a riser system as stated in claim 5 wherein said attachment means includes
a flange on the upper end of said inner shell,
and a plate secured to the portion of the central riser passing through said buoyant structure and secured to said flange.

10. A riser system as stated in claim 1 wherein said control means includes
a production control module carried by an umbilical line positioned in said riser means and having a releasable connection to said base manifold means,
said module providing hydraulic and electrical power and a remote signal receiver for control of equipment of said manifold means and at remote wells.

11. A riser system as stated in claim 10 wherein said umbilical line has a releasable connection at said buoyant structure for retrieval of the upper riser portion.

12. In a production riser system comprising in combination:
a floating platform;
a manifold base means on the seabed;
a riser means extending between said floating platform and said manifold base means;
and a buoyant structure attached to said riser means between said platform and base means;
said riser means having an upper riser portion extending between said platform and said buoyant structure;
said riser means having a lower riser portion between said buoyant structure and said manifold base means,
said upper and lower riser portions including a central riser pipe and a plurality of satellite riser pipes,
said central riser pipe at the lower riser portion being supported by said buoyant structure and said central riser pipe at the upper riser portion being supported by said platform,
said central riser pipe carrying guide means at selected spaced intervals for said satellite riser pipes,
each of said satellite riser pipes passing through said guide means and through said buoyant structure and supported from said platform
and means releasably interconnecting said lower riser portion with said upper riser portion at the level of said buoyant structure.

13. In a system as stated in claim 12 including
said upper riser portion includes flexible satellite riser pipes,
means at said platform supporting each of said flexible satellite riser pipes for removal of each satellite riser pipe independently of the other satellite riser pipes and the central riser pipes.

14. A system as stated in claim 12 including
means cooperable with said lower riser portion and buoyant structure for maintaining said lower riser portion in vertical position under positive buoyant conditions.

15. A system as stated in claim 12 wherein said upper riser portion includes
rigid central and satellite riser pipes, said central riser pipe supporting said satellite riser pipes.

16. In a system as stated in claim 12 wherein said means releasably interconnecting the lower riser means with the upper riser means includes
a guiding and connecting assembly at and above said buoyant structure.

17. In a riser system as stated in claim 16 including
control means cooperable with said guiding and connecting assembly for rapid release and separation of said upper riser portion from said buoyant structure and lower riser portion.

18. A system as stated in claim 16 wherein
said upper riser portion includes steel satellite riser pipes;
said guiding and connecting assembly includes means at the top of said assembly for carrying each of said steel satellite riser pipes for removal of each of said steel satellite riser pipes from said assembly.

19. In a riser system as stated in claim 12 wherein said means releasably interconnecting said lower riser portion with said upper riser portion at the level of said buoyant structure includes
guiding and connecting assembly above said buoyant structure;
said guiding and connecting assembly including means for receiving control pods lowered from said platform;
riser connector means at said guiding and connecting assembly for said upper riser portion;
an hydraulic circuit control means connecting said control pods with said riser connector means for rapid release and separation of said upper riser portion from said buoyant structure and lower riser portion at said guiding and connecting assembly.

20. In a system as stated in claim 12 wherein said manifold base means includes
a permanent fixed manifold section;
and a releasable manifold section connected to said fixed section and to the lower end of said lower riser portion.

21. A system as stated in claim 12 including
means on said platform for supporting and tensioning said upper riser portion whereby said upper riser portion imposes virtually no loads on said buoyant structure.

22. In a system as stated in claim 12 including
means adjacent said releasably interconnecting means for inhibiting transmission of forces from said floating platform caused by movement thereof through said upper riser portion to said lower riser portion.

23. In a riser system as stated in claim 12 including
means for preventing said buoyant structure from surfacing upon failure of said lower riser portion.

24. In a riser system as stated in claim 23 wherein said prevention means includes
umbilical control lines means connected with said manifold base means and with said buoyant structure to serve as tethering means.

25. In a riser system as stated in claim 23 wherein said prevention means includes
an umbilical line supported by said buoyant structure.

26. In a riser system as stated in claim 12 wherein said upper riser portion and an upper umbilical control line means is supported from said platform, a lower umbilical line supported for said buoyant structure, and means interconnecting said upper and lower umbilical lines at said buoyant structure.

27. In a production riser system for use between a floating platform at the sea surface and a base means at the seabed wherein said riser system is adapted to be separated under unfavorable environmental and/or operating conditions into an upper riser portion of selected length and a lower riser portion of a length dependent upon the depth of water to the seabed, the combination of:

buoyant means attached to the lower riser portion to support said lower riser portion in a self-supporting condition upon such separation;

means supporting said upper riser portion from said platform whereby said upper riser portion imparts virtually no loading on said lower riser portion when operably connected to said lower riser portion;

means for separating said upper and lower riser portions adjacent the buoyant means;

control means on the platform and extending along said upper and lower riser portions for controlling said base means and for actuating said separating means;

said control means including at least a pair of umbilical lines interconnecting said base means and said buoyant means for tethering said lower riser portion and said buoyant means upon separation.

28. In a production riser system as claimed in claim 27 wherein said buoyant means includes a buoyant structure having a central through opening for passing said lower riser portion therethrough.

29. In a production riser system as claimed in claim 27 wherein said buoyant means includes buoyant members attached to and encircling said lower riser portion.

* * * * *

UNITED STATES PATENT AND TRADEMARK OFFICE

CERTIFICATE OF CORRECTION

PATENT NO. : 4,098,333

DATED : July 4, 1978

INVENTOR(S) : Donald R. Wells and Raymond W. Walker

It is certified that error appears in the above-identified patent and that said Letters Patent are hereby corrected as shown below:

Column 19, line 42 insert --extending-- after "portion" and before "between".

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*